US009637338B2

(12) United States Patent
Nakai

(10) Patent No.: US 9,637,338 B2
(45) Date of Patent: May 2, 2017

(54) PAPER SHEET CONVEYOR AND PAPER SHEET CONVEYANCE METHOD

(71) Applicant: GLORY LTD., Himeji-shi, Hyogo (JP)

(72) Inventor: Takanori Nakai, Himeji (JP)

(73) Assignee: GLORY LTD., Himeji-shi (JP)

( * ) Notice: Subject to any disclaimer, the term of this patent is extended or adjusted under 35 U.S.C. 154(b) by 0 days.

(21) Appl. No.: 14/392,147

(22) PCT Filed: Jun. 26, 2014

(86) PCT No.: PCT/JP2014/066958
§ 371 (c)(1),
(2) Date: Dec. 23, 2015

(87) PCT Pub. No.: WO2014/208657
PCT Pub. Date: Dec. 31, 2014

(65) Prior Publication Data

US 2016/0272448 A1 Sep. 22, 2016

(30) Foreign Application Priority Data

Jun. 28, 2013 (JP) ..... 2013-136692
Dec. 20, 2013 (JP) ..... 2013-264037

(51) Int. Cl.
*B65H 9/10* (2006.01)
*B65H 9/00* (2006.01)
(Continued)

(52) U.S. Cl.
CPC ..... *B65H 9/20* (2013.01); *B65H 5/062* (2013.01); *B65H 7/10* (2013.01); *B65H 9/002* (2013.01);
(Continued)

(58) Field of Classification Search
CPC ..... B65H 9/00; B65H 9/002; B65H 9/103; B65H 9/20; B65H 7/10
See application file for complete search history.

(56) References Cited

U.S. PATENT DOCUMENTS 5,273,274 A * 12/1993 Thomson ..... B65H 7/10 271/228
6,008,824 A 12/1999 Nitta
(Continued)

FOREIGN PATENT DOCUMENTS

DE 10 2008 038 771 A1 2/2010
EP 2 801 542 A2 11/2014
(Continued)

OTHER PUBLICATIONS

Chinese Office Action and English translation, Application No. 201480042700.5, Sep. 26, 2016, 19 pages.
Extended European Search Report, Jan. 26, 2017, 8 pages.

*Primary Examiner* — Luis A Gonzalez
(74) *Attorney, Agent, or Firm* — Foley & Lardner LLP

(57) ABSTRACT

A paper sheet transport apparatus (10) includes transport member that is slidable along the widthwise direction of a transport path (11) (e.g., a drive roller (36) and a driven roller (38)), and a paper sheet detection unit (inlet-side paper sheet detection sensor (70)) that is arranged on an upstream side of the transport member in the paper sheet transport direction along the transport path (11) and detects the position of the paper sheet in the widthwise direction of the transport path (11). A control unit (80) calculates an amount of movement of the transport member based on the position of the paper sheet in the widthwise direction of the transport path (11) detected by the paper sheet detection unit and a previously set predetermined position of the paper sheet in the widthwise direction of the transport path (11).

20 Claims, 16 Drawing Sheets

(51) Int. Cl.
*B65H 5/06* (2006.01)
*B65H 9/20* (2006.01)
*B65H 7/10* (2006.01)

(52) U.S. Cl.
CPC ..... *B65H 9/103* (2013.01); *B65H 2404/1523* (2013.01); *B65H 2701/1912* (2013.01)

(56) References Cited

U.S. PATENT DOCUMENTS

| | | | | |
|---|---|---|---|---|
| 2012/0025438 | A1 | 2/2012 | Fukatsu et al. | |
| 2013/0134662 | A1 | 5/2013 | Moriya | |
| 2013/0307213 | A1* | 11/2013 | Adachi | B65H 7/14 271/265.01 |
| 2013/0334769 | A1* | 12/2013 | Yamazaki | B65H 7/10 271/228 |
| 2014/0312561 | A1* | 10/2014 | Park | B65H 9/106 271/227 |

FOREIGN PATENT DOCUMENTS

| | | | |
|---|---|---|---|
| JP | 61-273449 | A | 12/1986 |
| JP | 05-104802 | A | 4/1993 |
| JP | 2006-111446 | A | 4/2006 |
| JP | 2012-025569 | A | 2/2012 |
| JP | 2013-112444 | A | 6/2013 |

* cited by examiner

PAPER SHEET CONVEYOR AND PAPER SHEET CONVEYANCE METHOD

TECHNICAL FIELD

The present invention relates to a paper sheet transport apparatus and a paper sheet transport method of transporting paper sheets such as banknotes. More specifically, the present invention relates to a paper sheet transport apparatus and a paper sheet transport method of aligning a transported paper sheet to a predetermined position, such as a center position, in the widthwise direction of a transport path.

BACKGROUND ART

In a banknote depositing and dispensing apparatus that performs processes for depositing and dispensing banknotes such as an automatic teller machine (ATM) installed in financial institutions such as banks, a banknote transport apparatus that transports banknotes is installed inside the body of the banknote depositing and dispensing apparatus. Banknotes transported by such a banknote transport apparatus are stored in storage cassettes. If the width of the banknote transport path in the banknote transport apparatus is wider than the width of the opening portion of the storage cassette, it is necessary to align the banknote transported by the banknote transport apparatus to a predetermined position, such as the center position, in the widthwise direction of the transport path. To explain in more detail, plural types of banknotes exist and the dimensions of the banknotes differ depending on the issuing country and the denomination thereof. Accordingly, when handling various types of banknotes, if each type of the banknotes is to be stored in a different storage cassette with the size appropriate for the type of the banknotes, the dimension of the opening portions of the storage cassettes will be different according to the type of the banknotes. Therefore, in order to surely store the banknotes into the various types of storage cassettes, it is necessary to align the position of the banknote in the widthwise direction of the transport path to the predetermined position.

With respect to adjustment of the position of a banknote in the widthwise direction of the transport path, Japanese Patent Application Laid-open No. 2006-111446 (JP2006-111446A) discloses a banknote shifting apparatus. This banknote shifting apparatus includes plural skewing transport rollers. A surface of the skewing transport roller is formed with a rubber member, and a banknote is forcedly shifted along the widthwise direction of the transport path by skewing the banknote by using the skewing transport rollers.

SUMMARY OF INVENTION

However, in the conventional banknote shifting apparatus disclosed in Japanese Patent Application Laid-open No. 2006-111446 (JP2006-111446A), because the banknote is forcedly shifted by using the rollers to adjust the position of the banknote in the widthwise direction of the transport path, if a damaged banknote is transported by the banknote transport apparatus, troubles such as tearing of the banknote may occur. Moreover, in the conventional banknote shifting apparatus, the position of a shifting unit that shifts the banknote along the widthwise direction of the transport path is fixed. Therefore, a problem may arise such that the banknote cannot be surely shifted along the widthwise direction of the transport path depending on the position of the banknote in relation to the transport path and the state of skewing of the banknote.

The present invention has been devised in consideration of the above discussion. It is an object of the present invention to provide a paper sheet transport apparatus and a paper sheet transport method capable of aligning a paper sheet to a predetermined position by surely shifting the paper sheet along the widthwise direction of the transport path, and also capable of preventing damaging of the paper sheet during alignment of the paper sheet to the predetermined position in the widthwise direction of the transport path.

A paper sheet transport apparatus of the present invention is a paper sheet transport apparatus that transports a paper sheet along a transport path, including a transport member that is slidable along a widthwise direction of the transport path and transports the paper sheet along the transport path; a paper sheet detection unit that is arranged on an upstream side of the transport member in a paper sheet transport direction along the transport path and detects a position of the paper sheet in the widthwise direction of the transport path; and a control unit that calculates an amount of movement of the transport member based on a position of the paper sheet in the widthwise direction of the transport path detected by the paper sheet detection unit and a previously set predetermined position of the paper sheet in the widthwise direction of the transport path, and performs a control so as to slide the transport member by the calculated movement amount when the paper sheet is transported by the transport member.

In the paper sheet transport apparatus of the present invention, the transport member may include a pair of upper and lower rollers that transport the paper sheet by nipping the paper sheet therebetween.

The paper sheet transport apparatus of the present invention may further include a position detection unit that detects a position of the transport member in the widthwise direction of the transport path.

In the paper sheet transport apparatus of the present invention, the transport member may be arranged in a first guide portion that constitutes the transport path, and the first guide portion may be slidable along the widthwise direction of the transport path integrally with the transport member.

In this case, the first guide portion may include a pair of first guide portions arranged so as to be separated from each other, in which the transport path is formed between the first guide portions, and the pair of first guide portions may be slidable so that a distance between the first guide portions on an inlet side of the transport path arranged between the pair of the first guide portions and a distance between the first guide portions on an outlet side of the transport path can be respectively changed.

Also, the pair of the first guide portions may be respectively capable of rocking around a shaft, and the paper sheet transport apparatus may include a guide portion rocking mechanism for changing the distance between the first guide portions on the inlet side of the transport path arranged between the first guide portions and the distance between the first guide portions on the outlet side thereof by rocking the pair of first guide portions, respectively.

In the paper sheet transport apparatus of the present invention, the transport member may be arranged in a second guide portion that constitutes the transport path, the second guide portion may be firmly fixed, and the transport member may be slidable along the widthwise direction of the transport path with respect to the second guide portion.

In the paper sheet transport apparatus of the present invention, the transport member may include a plurality of the transport members arranged in tandem along the paper sheet transport direction, in the transport path, the paper sheet may be transported sequentially starting from the transport member arranged on a most upstream side toward the transport members arranged on a downstream side thereof, and the control unit may control the transport members to slide along the widthwise direction of the transport path so that a sum total of amounts of movement of the paper sheet in the widthwise direction of the transport path performed by the transport members is equal to the calculated movement amount when the paper sheet is transported sequentially by the transport members.

In this case, if the calculated movement amount is smaller than a maximum movement amount of each of the transport members, the control unit may control only a part of the plural transport members along the widthwise direction of the transport path.

Also, when the paper sheet has been transported from one transport member to another transport member arranged at a stage subsequent to the one transport member, the control unit may perform a control to move the one transport member to a position where it can receive a subsequent paper sheet.

Also, in the control unit, time duration from a time point at which the paper sheet is detected by the paper sheet detection unit or an inlet-side transport timing detection unit that detects a timing of transport of the paper sheet arranged on an upstream side of the transport members in paper sheet transport direction to a time point at which the sliding of the transport members is to be started may be set for each of the transport members, and the control unit may perform a control so as to slide the transport members along the widthwise direction of the transport path after the previously set time duration has elapses for each of the transport members after the paper sheet has been detected by the paper sheet detection unit or the inlet-side transport timing detection unit.

Also, the paper sheet transport apparatus of the present invention may further include a transport timing detection unit that detects passing of the paper sheet in each transport member, and when the passing of the paper sheet has been detected by the transport timing detection unit, the control unit may perform a control so as to slide the transport member corresponding to this transport timing detection unit along the widthwise direction of the transport path.

The paper sheet transport apparatus of the present invention, may further include a first fixed transport member and a second fixed transport member arranged on an upstream side and on a downstream side of the transport member in the paper sheet transport direction, the first fixed transport member and the second fixed transport member being firmly fixed and transporting the paper sheet along the transport path, the paper sheet detection unit also may detect a skew amount of the paper sheet, and the control unit may perform a control so as to slide the transport member along the widthwise direction of the transport path so as to correct a skew state of the paper sheet based on the skew amount of the paper sheet detected by the paper sheet detection unit when the paper sheet is transported from the first fixed transport member to the transport member or when the paper sheet is transported from the transport member and received by the second fixed transport member.

In the paper sheet transport apparatus of the present invention, the transport member may include a plurality of the transport members arranged in tandem along the paper sheet transport direction, in the transport path, the paper sheet is transported sequentially starting from the transport member arranged on a most upstream side toward the transport members arranged on a downstream side thereof, the paper sheet detection unit may also detect the skew amount of the paper sheet, and when the paper sheet is transported from one transport member to another transport member arranged at a stage subsequent to the one transport member, the control unit may control at least one of the one transport member and the another transport member to slide along the widthwise direction of the transport path so as to correct the skewed state of the paper sheet based on the skew amount of the paper sheet detected by the paper sheet detection unit.

Also, in the transport member, a plurality of pairs of upper and lower rollers that transport the paper sheet by nipping the paper sheet therebetween may be arranged in tandem along the widthwise direction of the transport path, and the control unit may adjust a rotation speed of each of the plurality of pairs of rollers arranged in the transport member so as to correct the skewed state of the paper sheet based on the skew amount of the paper sheet detected by the paper sheet detection unit when the paper sheet is transported by the transport member.

The paper sheet transport apparatus of the present invention may further include a first fixed transport member and a second fixed transport member arranged on the upstream side of and on the downstream side of the transport member in the paper sheet transport direction, the first fixed transport member and the second fixed transport member being firmly fixed and transport the paper sheet along the transport path, the first fixed transport member, the transport member, and the second fixed transport member may be constituted by a pair of upper and lower rollers that transport the paper sheet by nipping the paper sheet therebetween, and the rollers of the first fixed transport member, the transport member, and the second fixed transport member may be driven by a single drive system.

In this case, driving force from the rollers may be transmitted between the first fixed transport member, the transport member, and the second fixed transport member via a drive gear that extends along the widthwise direction of the transport path.

A paper sheet transport method of the present invention is a paper sheet transport method performed by a paper sheet transport apparatus including a transport member that is slidable along a widthwise direction of a transport path and transports a paper sheet along the transport path, the method including detecting a position of the paper sheet in the widthwise direction of the transport path at a position on an upstream side of the transport member in a paper sheet transport direction; calculating an amount of movement of the transport member based on the detected position of the paper sheet in the widthwise direction of the transport path and a previously set predetermined position of the paper sheet in the widthwise direction of the transport path; and sliding the transport member along the widthwise direction of the transport path by the calculated movement amount when the paper sheet is transported by the transport member.

In the paper sheet transport method of the present invention, the transport member may include a pair of upper and lower rollers that transport the paper sheet by nipping the paper sheet therebetween, and the paper sheet may be transported while being nipped between the pair of upper and lower rollers when the paper sheet is transported by the transport member.

In the paper sheet transport method of the present invention, a plurality of the transport members may be arranged in tandem along the paper sheet transport direction, in the transport path, the paper sheet may be transported sequentially starting from the transport member arranged on a most upstream side toward the transport members arranged on a downstream side thereof, and when the paper sheet is transported sequentially by the transport members, the transport members may be slid along the widthwise direction of the transport path so that a total sum of amounts of movement of the paper sheet performed by the transport members in the widthwise direction of the transport path is equal to the calculated movement amount.

BRIEF DESCRIPTION OF DRAWINGS

FIG. 4 is a perspective view of a detailed structure of a sliding transport mechanism of the paper sheet transport apparatus shown in FIG. 1 and the like.

FIG. 5 is a functional block diagram of the paper sheet transport apparatus shown in FIG. 1 and the like.

FIGS. 6A(a) to 6A(e) are explanatory drawings of an example of a paper sheet transport method performed by the paper sheet transport apparatus shown in FIG. 1 and the like.

FIGS. 6B(a) to 6B(f) are explanatory drawings continued from FIG. 6A(e) and show the paper sheet transport method performed by the paper sheet transport apparatus shown in FIG. 1 and the like.

FIGS. 7(*a*) to 7(*f*) are explanatory drawings of another example of the paper sheet transport method performed by the paper sheet transport apparatus shown in FIG. 1 and the like.

FIG. 8 is an explanatory drawing of a method of correcting a skewed state of the paper sheet performed in the paper sheet transport apparatus shown in FIG. 1 and the like.

FIG. 11 is a side view of a mechanism for rocking the upper guide portion and the lower guide portion of the sliding transport mechanism of the paper sheet transport apparatus shown in FIG. 9 and the like.

DESCRIPTION OF EMBODIMENTS

First Embodiment

Figure 1:
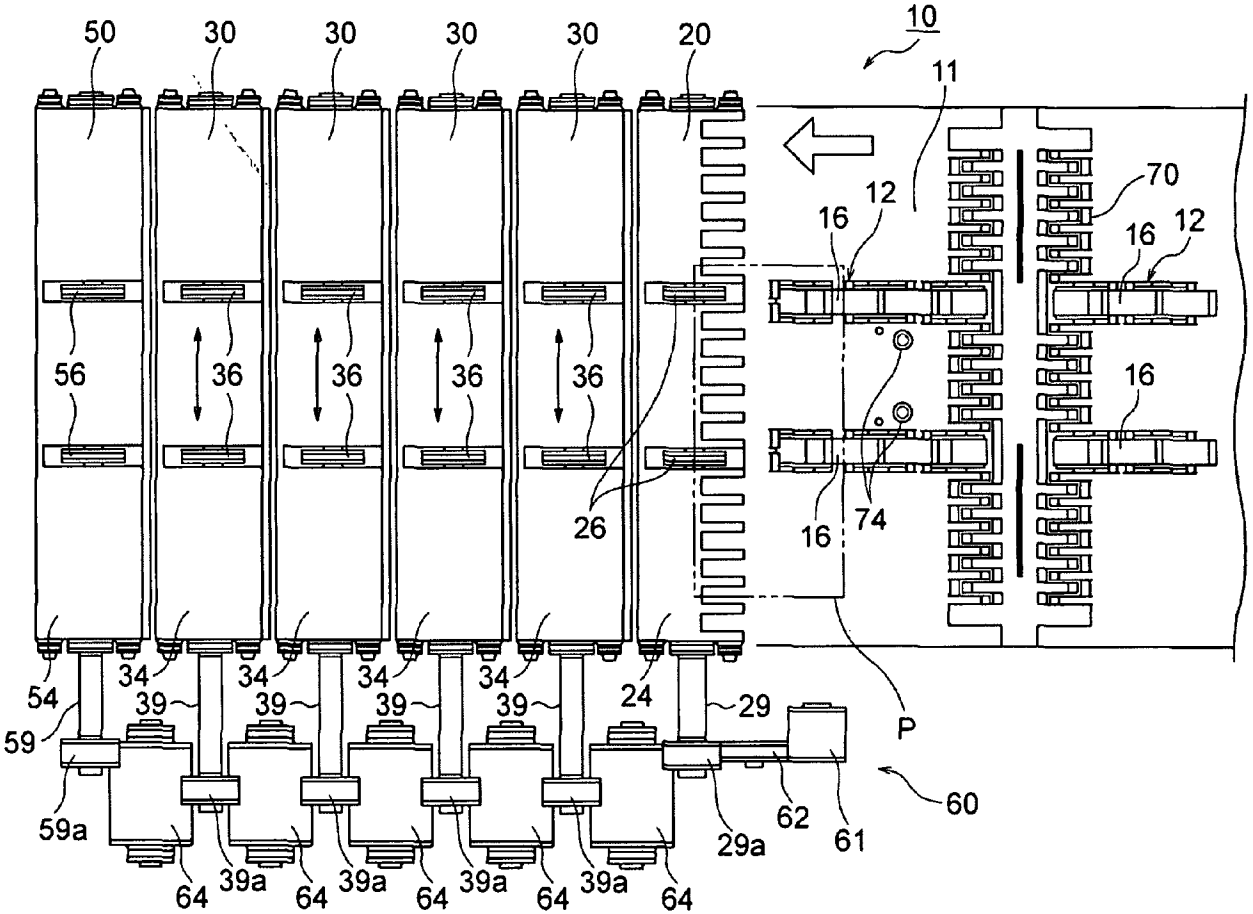
FIG. 1 is a schematic structural diagram of a paper sheet transport apparatus according to a first embodiment of the present invention.
Figure 2:
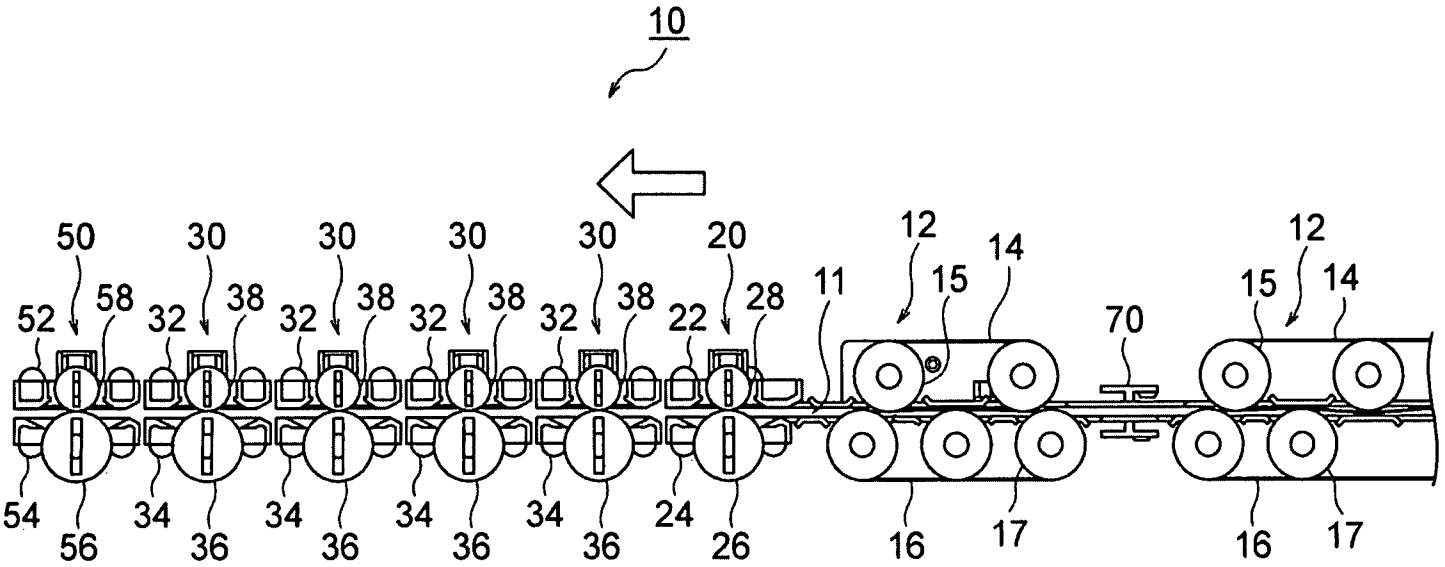
FIG. 2 is a side view of the paper sheet transport apparatus shown in FIG. 1.
Figure 3:
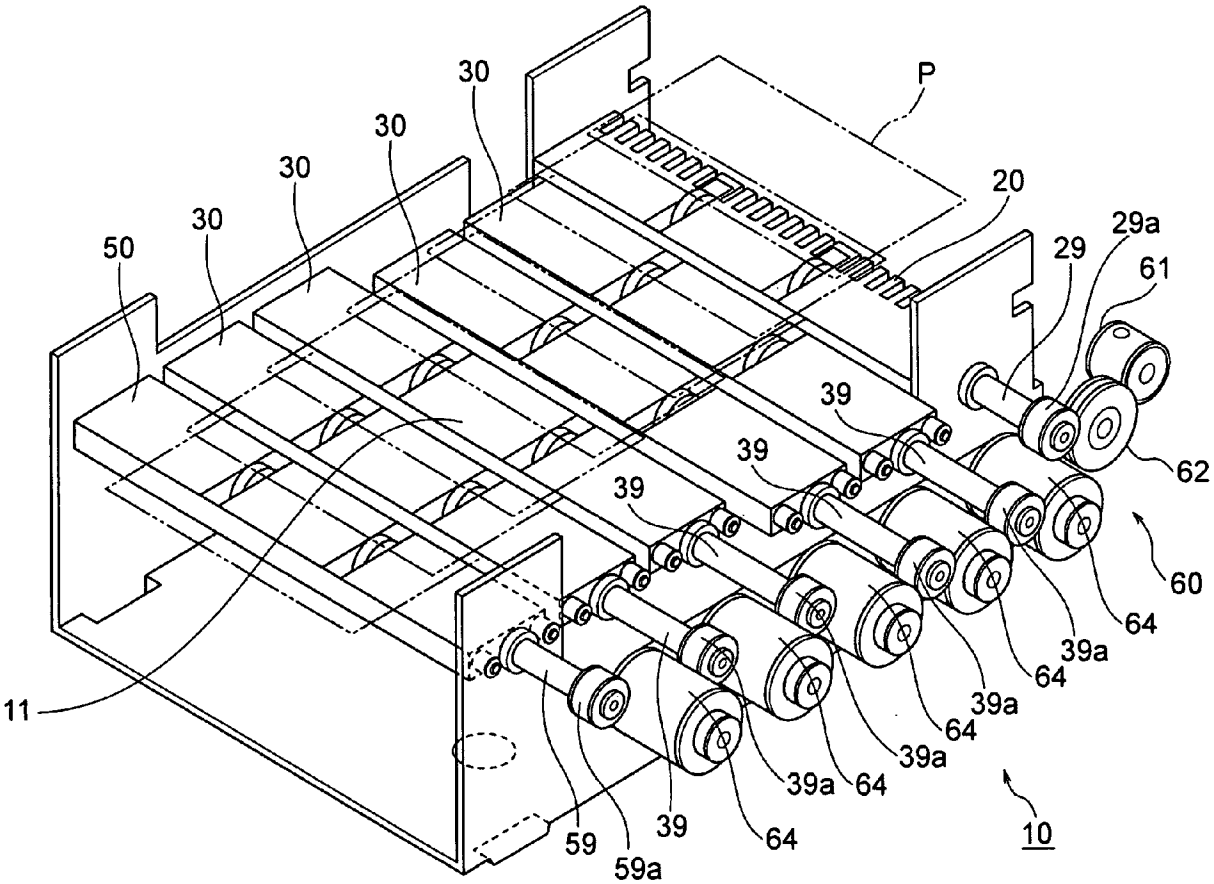
FIG. 3 is a perspective view of the paper sheet transport apparatus shown in FIGS. 1 and 2.
Figure 4:
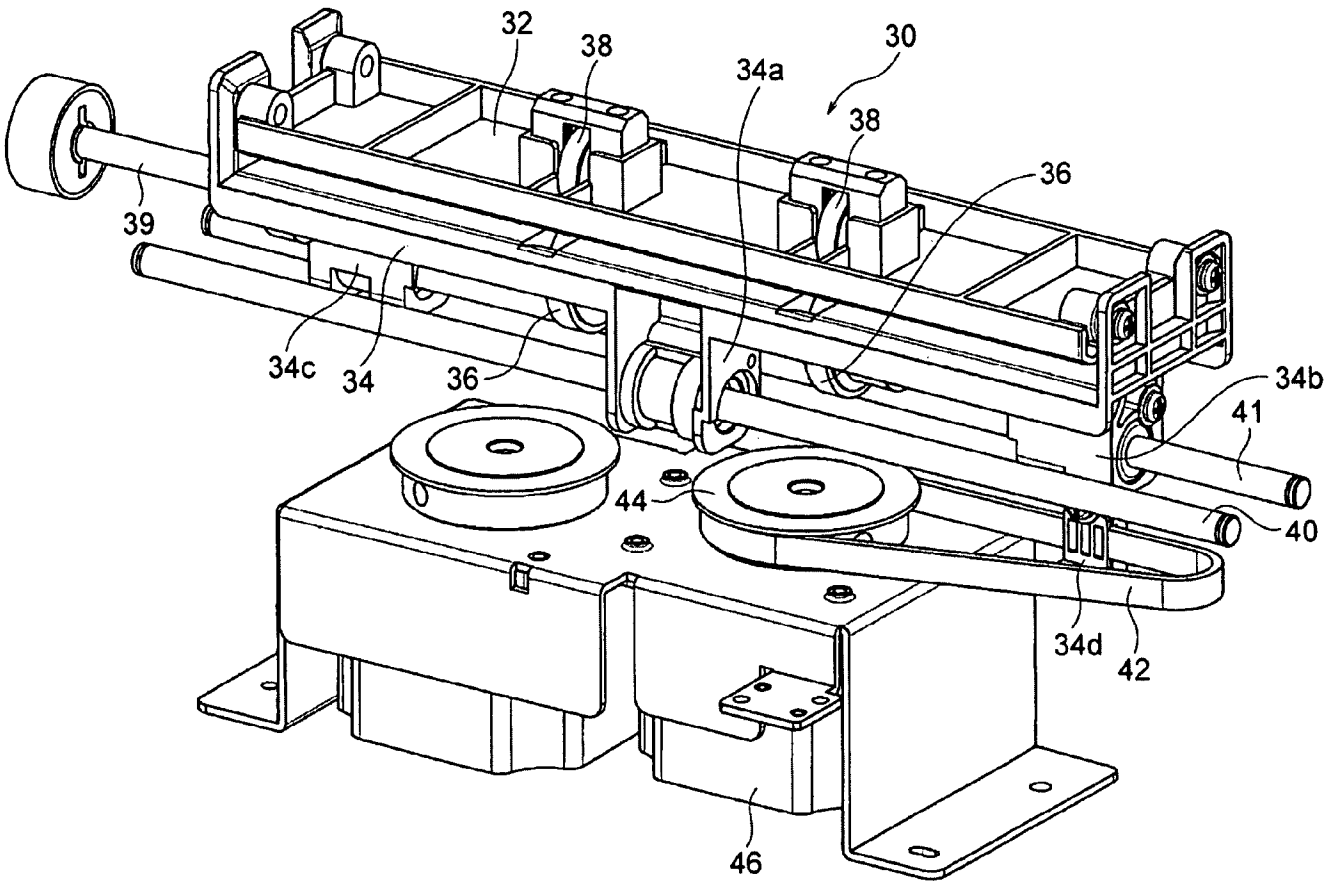
Figure 5:
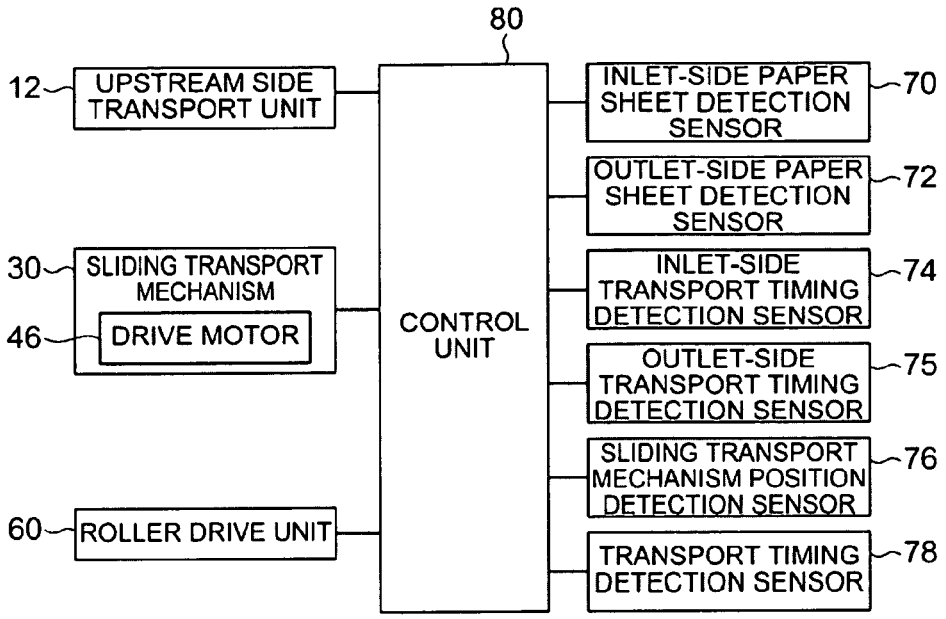
Figure 6A:
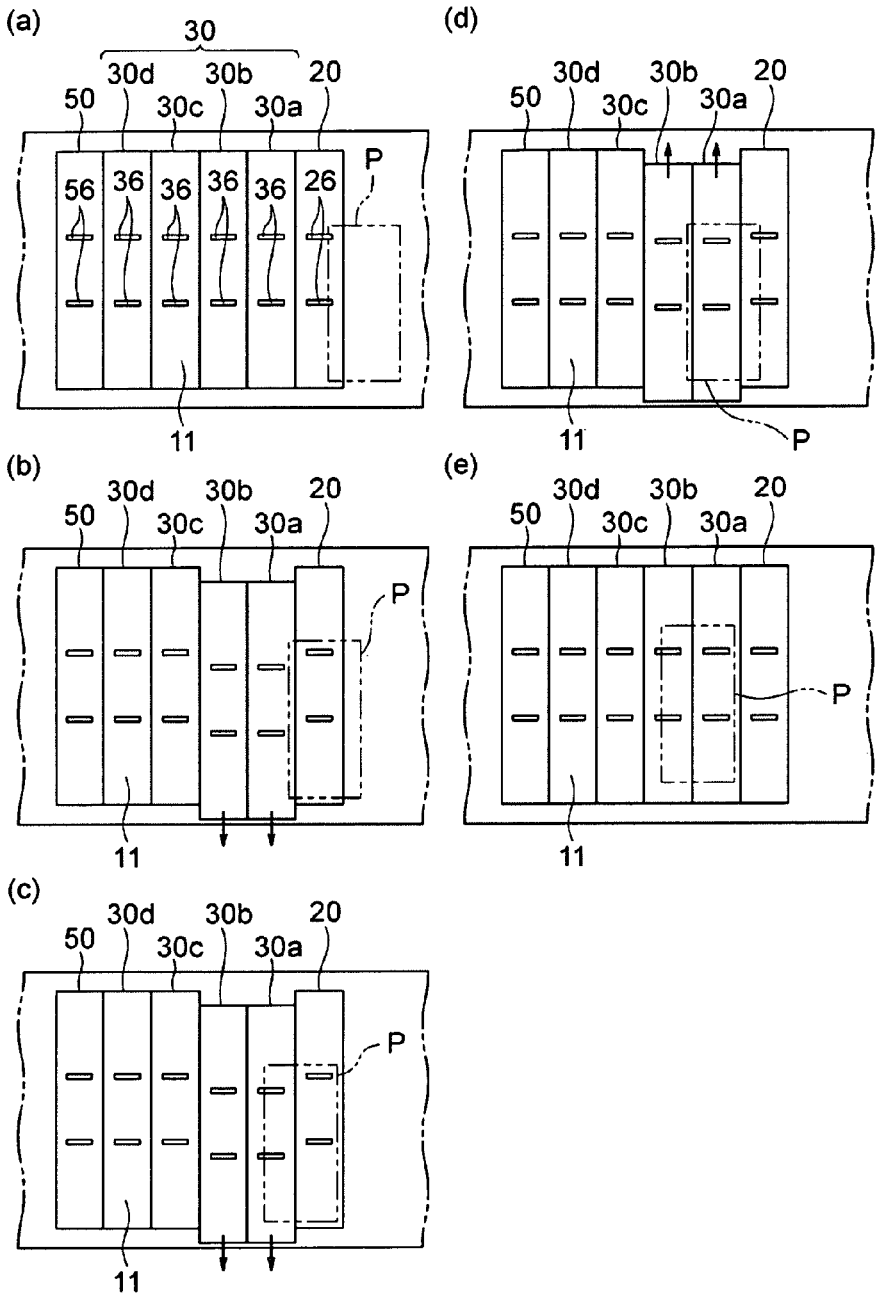
Figure 6B:
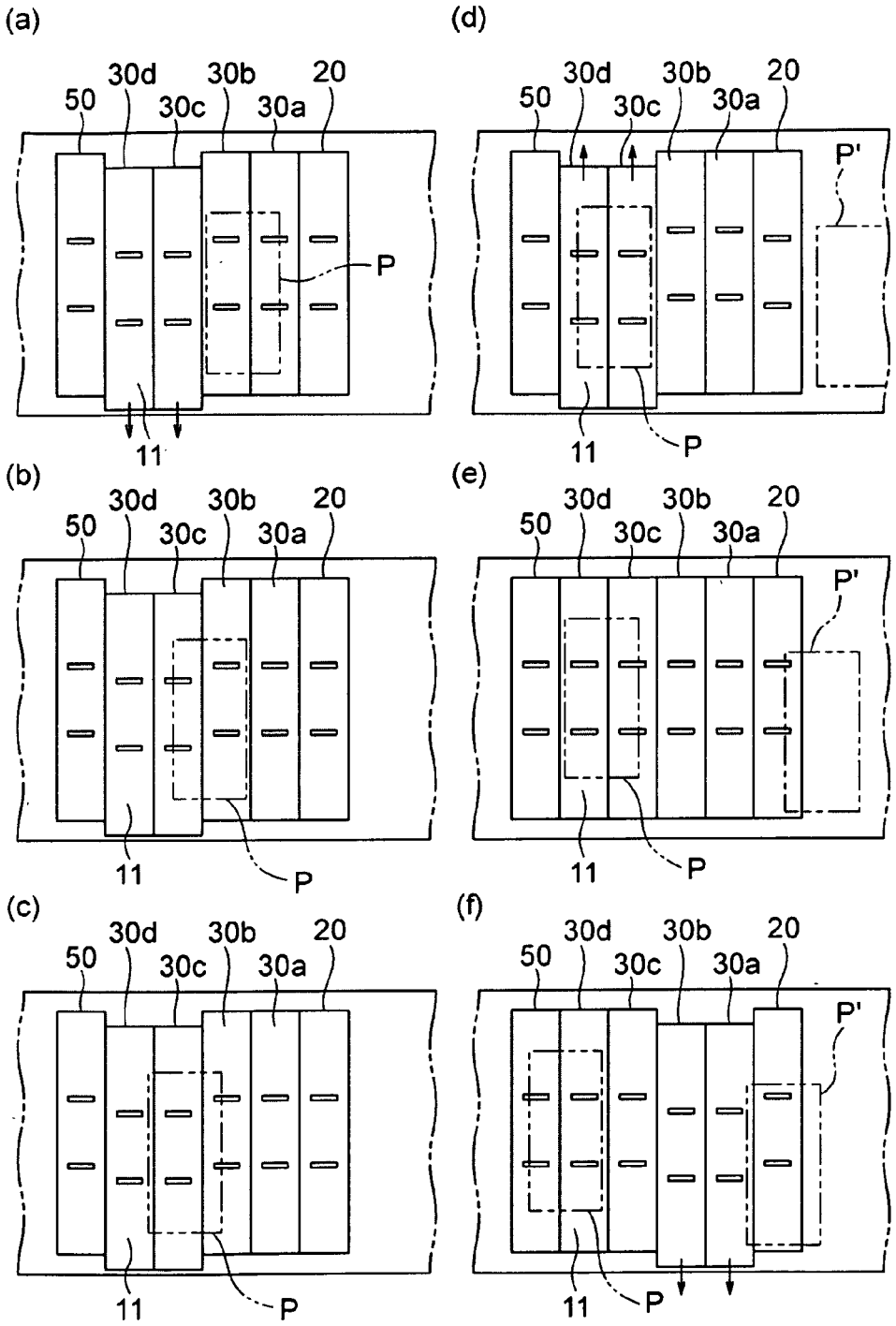
Figure 7:
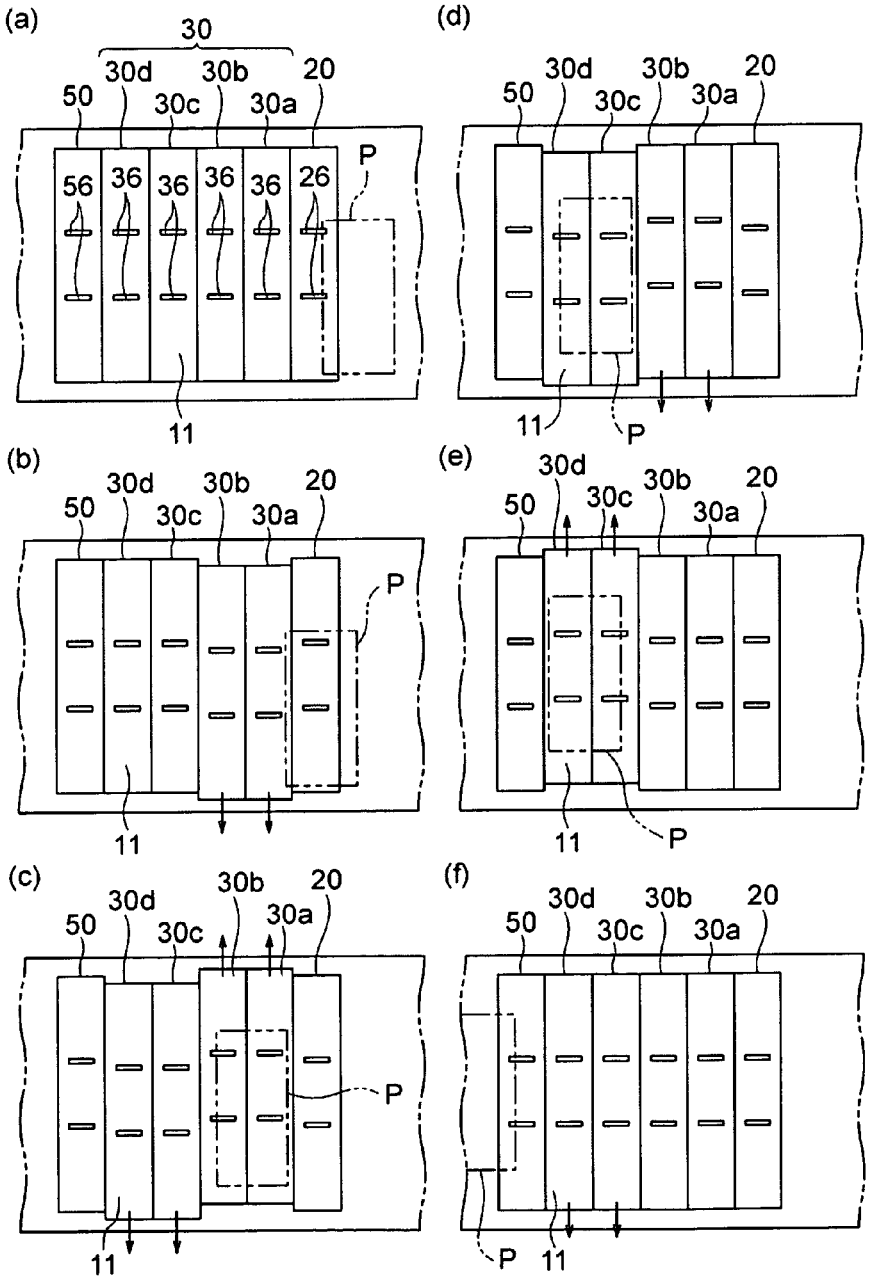
Figure 8:
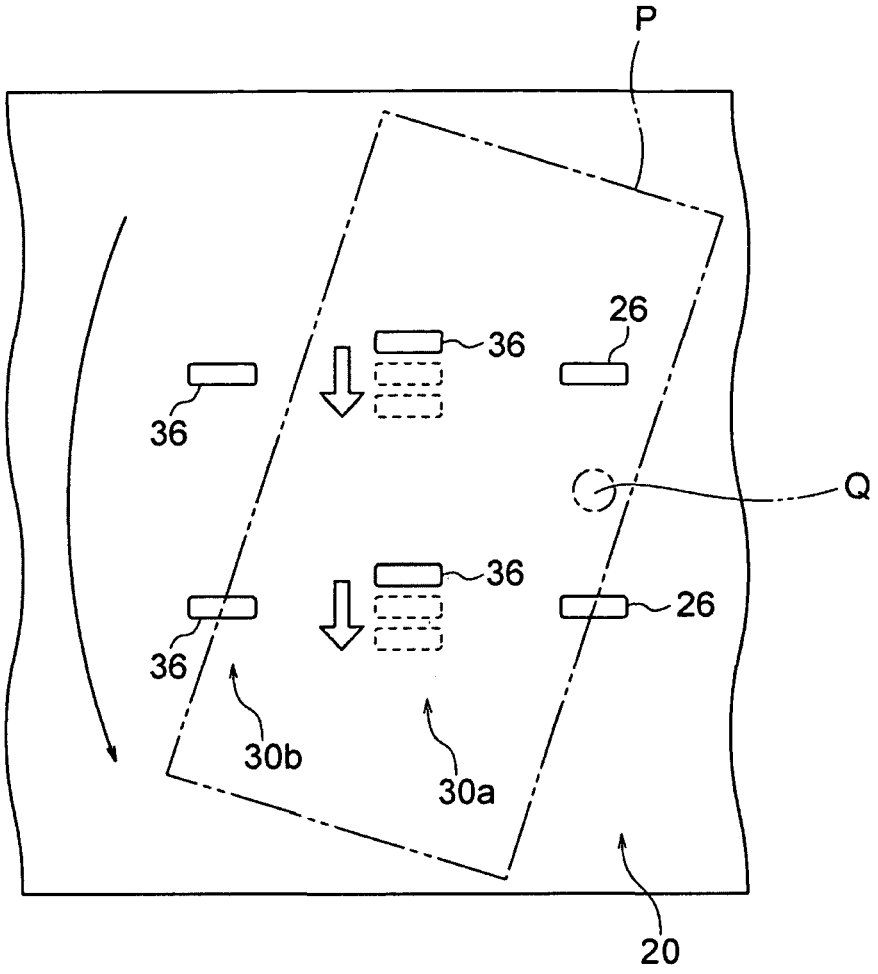

A first embodiment of the present invention will be explained below with reference to accompanying drawings. FIGS. 1 to 8 show a paper sheet transport apparatus and a paper sheet transport method according to the present embodiment. Among the drawings, FIG. 1 is a schematic structural diagram of the paper sheet transport apparatus according to the present embodiment, FIG. 2 is a side view of the paper sheet transport apparatus shown in FIG. 1, and FIG. 3 is a perspective view of the paper sheet transport apparatus shown in FIGS. 1 and 2. FIG. 4 is a perspective view of a detailed structure of a sliding transport mechanism of the paper sheet transport apparatus shown in FIG. 1 and the like. FIG. 5 is a functional block diagram of the paper sheet transport apparatus shown in FIG. 1 and the like. FIGS. 6A and 6B are explanatory drawings of an example of the paper sheet transport method performed by the paper sheet transport apparatus shown in FIG. 1 and the like, and FIG. 7 is an explanatory drawing of another example of the paper sheet transport method performed by the paper sheet transport apparatus shown in FIG. 1 and the like. FIG. 8 is an explanatory drawing of a method of correcting a skewed state of the paper sheet performed in the paper sheet transport apparatus shown in FIG. 1 and the like.

A paper sheet transport apparatus 10 according to the present embodiment transports paper sheets such as banknotes (the paper sheet is shown with a reference symbol P in FIG. 1 and the like), one by one. When transporting the paper sheet, paper sheet transport apparatus 10 aligns the transported paper sheet to a predetermined position, such as a center position in a widthwise direction (that is, in an upward-downward direction in FIG. 1), of a transport path 11. The paper sheet transport apparatus 10 can be used as a banknote transport apparatus installed inside a body of a banknote depositing and dispensing apparatus that performs depositing and dispensing of banknotes, such as an ATM and the like, installed in a financial institution such as banks, for example. The paper sheet transport apparatus 10 adjusts the position of the banknote in the widthwise direction of the transport path to the predetermined position so that the banknotes are surely stored into various storage cassettes arranged inside the body of the banknote depositing and dispensing apparatus. A schematic configuration of the paper sheet transport apparatus 10 will be explained below.

The paper sheet transport apparatus 10 according to the present embodiment includes a first fixed transport unit 20, which is firmly fixed and transports a paper sheet along the transport path 11; plural (e.g., four) sliding transport mechanisms 30, which are slidable along the widthwise direction of the transport path 11 (that is, in the upward-downward direction in FIG. 1) and transport the paper sheet received from the first fixed transport unit 20; and a second fixed transport unit 50, which is firmly fixed and transports the paper sheet received from the sliding transport mechanism 30. Upstream side transport units 12 are arranged on an upstream side of the first fixed transport unit 20 in a paper sheet transport direction. As shown in FIG. 1, paper sheets are transported by the paper sheet transport apparatus 10, one by one, from right to left along the transport path 11, which extends in the left-right direction in FIG. 1. The paper sheets are transported with a short edge thereof parallel to the paper sheet transport direction. However, the structure of the paper sheet transport apparatus 10 according to the present embodiment is not limited to the one explained above. For example, the paper sheets can be transported with a long edge thereof parallel to the paper sheet transport direction.

Each component of the paper sheet transport apparatus 10 will be explained below.

As shown in FIGS. 1 and 2, each upstream side transport unit 12 includes an upper side transport belt 14, which is stretched around plural upper rollers 15, and a lower transport belt 16, which is stretched around plural lower rollers 17. In FIG. 1, a structure of the lower transport belt 16 in a state in which the upper side transport belt 14 and the upper rollers 15 are disassembled from the paper sheet transport apparatus 10 is shown. In the present embodiment, a drive motor is arranged on one lower roller 17 among the plural lower rollers 17. When this lower roller 17 is rotated by the drive motor, the lower transport belt 16 circulates and moves in the counterclockwise direction in FIG. 2. The upper side transport belt 14 corotates with the lower transport belt 16. That is, when the lower transport belt 16 is circulated and moved in the counterclockwise direction in FIG. 2, the upper side transport belt 14 is corotated in the clockwise direction in FIG. 2. In the upstream side transport unit 12, the paper sheet is transported from right to left in FIGS. 1 and 2 in a state in which the paper sheet is nipped between the upper side transport belt 14 and the lower transport belt 16. As shown in FIG. 1, a pair of left and right lower transport belts 16 is arranged along the widthwise direction of the transport path 11 (that is, in the upward-downward direction in FIG. 1). Moreover, although not shown in the drawings, with respect to the upper side transport belt 14 corresponding to the lower transport belt 16, a pair of left and right upper transport belts is arranged along the widthwise direction of the transport path 11.

As shown in FIGS. 1 and 2, the first fixed transport unit 20 includes an upper guide portion 22 and a lower guide portion 24 that are arranged so as to be vertically separated from each other with a slight clearance. The transport path 11 along which the paper sheet is transported is formed between the upper guide portion 22 and the lower guide portion 24. As shown in FIG. 1, a pair of left and right drive rollers 26 is arranged in the lower guide portion 24 along the widthwise direction of the transport path 11. In the upper guide portion 22, a pair of left and right driven rollers 28 is arranged so as to oppose the drive rollers 26 along the widthwise direction of the transport path 11. In FIG. 1, the structure of the lower guide portion 24 and the drive rollers 26 in a state in which the upper guide portion 22 and the driven rollers 28 are disassembled from the first fixed transport unit 20 is shown.

In the first fixed transport unit 20, a high friction member, such as a rubber member, is arranged on an outer circumferential surface of each drive roller 26, for example. The drive rollers 26 are rotated by a later-explained roller drive unit 60 via a drive shaft 29 in the counterclockwise direction in FIG. 2. A metal member is arranged on the outer circumferential surface of each driven roller 28. The driven rollers 28 are arranged in the upper guide portion 22 so that the driven rollers 28 contact and corotate with the drive rollers 26. When the paper sheet is transported in a nip portion formed between the drive rollers 26 and the driven rollers 28, the paper sheet is transported toward the left in FIGS. 1 and 2 along the transport path 11.

The second fixed transport unit 50, similarly to the first fixed transport unit 20, includes an upper guide portion 52 and a lower guide portion 54 that are arranged so as to be vertically separated from each other with a slight clearance. The transport path 11 along which the paper sheet is transported is formed between the upper guide portion 52 and the lower guide portion 54. As shown in FIG. 1, a pair of left and right drive rollers 56 is arranged in the lower guide portion 54 along the widthwise direction of the transport path 11. Moreover, in the upper guide portion 52, a pair of left and right driven rollers 58 is arranged so as to oppose the drive rollers 56 along the widthwise direction of the transport path 11. In FIG. 1, the structure of the lower guide portion 54 and the drive rollers 56 in a state in which the upper guide portion 52 and the driven rollers 58 are disassembled from the second fixed transport unit 50 is shown.

In the second fixed transport unit 50, a high friction member such as a rubber member is arranged on an outer circumferential surface of each drive roller 56, for example. The drive rollers 56 are rotated by the later-explained roller drive unit 60 via a drive shaft 59 in the counterclockwise direction in FIG. 2. A metal member is arranged on an outer circumferential surface of each driven roller 58. The driven rollers 58 are arranged in the upper guide portion 52 so that the driven rollers 58 contact and corotate with the drive rollers 56. When the paper sheet is transported to a nip portion formed between the drive rollers 56 and the driven rollers 58, the paper sheet is transported toward the left in FIGS. 1 and 2 along the transport path 11.

Plural (e.g., four) sliding transport mechanisms 30 are arranged in tandem between the first fixed transport unit 20 and the second fixed transport unit 50 along the paper sheet transport direction. Each sliding transport mechanism 30 is slidable along the widthwise direction of the transport path 11 (in the upward-downward direction in FIG. 1) independently from the other sliding transport mechanisms 30. With this configuration, the paper sheet transported from each sliding transport mechanism 30 to the second fixed transport unit 50 is aligned to the predetermined position (e.g., the center position) in the widthwise direction of the transport path 11 by shifting the paper sheet with these sliding transport mechanisms 30 along the widthwise direction of the transport path 11. Accordingly, the paper sheet can be aligned to the predetermined position regardless of the position of the paper sheet in the widthwise direction of the transport path 11 in the first fixed transport unit 20 arranged on the upstream side of each sliding transport mechanism 30.

As shown in FIGS. 1 and 2, each sliding transport mechanism 30 includes an upper guide portion 32 and a lower guide portion 34 that are arranged so as to be vertically separated from each other with a slight clearance. The transport path 11 along which the paper sheet is transported is formed between the upper guide portion 32 and the lower guide portion 34. The upper guide portion 32 and the lower guide portion 34 are coupled with each other, whereby the upper guide portion 32 and the lower guide portion 34 are integrally slidable along the widthwise direction of the transport path 11. As shown in FIG. 1, a pair of left and right drive rollers 36 is arranged in the lower guide portion 34 along the widthwise direction of the transport path 11. Moreover, in the upper guide portion 32, a pair of left and right driven rollers 38 is arranged so as to oppose the drive rollers 36 along the widthwise direction of the transport path 11. In FIG. 1, the structure of the lower guide portion 34 and the drive roller 36 in a state in which the upper guide portion 32 and the driven rollers 38 are disassembled from each sliding transport mechanism 30 is shown.

In each sliding transport mechanism 30, a high friction member, such as a rubber member, is arranged on an outer circumferential surface of each drive roller 36, for example. The drive rollers 36 are rotated by the later-explained roller drive unit 60 via a drive shaft 39 in the counterclockwise direction in FIG. 2. A metal member is arranged on an outer circumferential surface of each driven roller 38. Moreover, the driven rollers 38 are arranged in the upper guide portion 32 so that the driven rollers 38 contact and corotate with the drive roller 36. When the paper sheet is transported to a nip portion formed between the drive rollers 36 and the driven rollers 38, the paper sheet is transported toward the left in FIGS. 1 and 2 along the transport path 11. In the present embodiment, a transport member that slides along the widthwise direction of the transport path 11 and transports the paper sheet along the transport path 11 is constituted by the drive rollers 36 and the driven rollers 38. In addition, in the present embodiment, a first guide portion is constituted by the upper guide portion 32 and the lower guide portion 34, and the transport path 11 is formed between them.

Next, in each sliding transport mechanisms 30, a mechanism that integrally slides the upper guide portion 32 and the lower guide portion 34 along the widthwise direction of the transport path 11 will be explained with reference to FIG. 4. As shown FIG. 4, two guide rails 40 and 41, which extend parallel to each other along the widthwise direction of the transport path 11, are arranged below the lower guide portion 34. A first lower portion member 34*a* is attached in the center and lower portion of the lower guide portion 34. A second lower portion member 34*b* and a third lower portion member 34*c* are attached at both ends of the lower portion of the lower guide portion 34. A cylindrical member is arranged in the first lower portion member 34*a*, and with the guide rail 40 that goes through the cylindrical member, the first lower portion member 34*a* can be slid and guided along the guide rail 40 in the horizontal direction. A cylindrical member is arranged in the second lower portion member 34*b* and the third lower portion member 34*c*, respectively, and with the guide rail 41 that goes through these cylindrical members, the second lower portion member 34*b* and the third lower portion member 34*c* can be slid and guided along the guide rail 41 in the horizontal direction.

In each sliding transport mechanism 30, an endless drive belt 42 is arranged below each guide rail 40 and 41 along the horizontal direction. The drive belt 42 is stretched around plural pulleys including a drive pulley 44 (pulleys other than the drive pulley 44 have been omitted from FIG. 4). In each sliding transport mechanism 30, a drive motor 46 such as a stepping motor, which rotates the drive pulley 44 in both the forward and the reverse directions, is arranged. A belt attaching portion 34*d* is arranged in the second lower portion member 34*b* attached to the lower guide portion 34 in its lower portion. The belt attaching portion 34*d* is attached to the drive belt 42. With this configuration, when the drive motor 46 rotates the drive pulley 44, the drive belt 42 stretched around the drive pulley 44 is circulated and moved, thus the belt attaching portion 34*d* is moved in the horizontal direction, and thereby the second lower portion member 34*b* and the third lower portion member 34*c* are moved along the guide rail 41. In this situation, the first lower portion member 34*a* is also moved along the guide rail 40, whereby the upper guide portion 32 and the lower guide portion 34 integrally slide along the widthwise direction of the transport path 11. In the present embodiment, the rotational drive of the drive pulley 44 imparted by the drive motor 46 is controlled by a later-explained control unit 80.

In each sliding transport mechanism 30, a sliding transport mechanism position detection sensor 76 (see FIG. 5; the sliding transport mechanism position detection sensor 76 is not shown in FIGS. 1 to 4) that detects the position of the upper guide portion 32 and the lower guide portion 34 in the widthwise direction of the transport path 11 (that is, in the upward-downward direction in FIG. 1) is arranged. More specifically, the sliding transport mechanism position detection sensor 76 detects the position of the first lower portion member 34*a* attached to the lower guide portion 34 in the center position of the lower portion thereof, for example, and detects the position of the upper guide portion 32 and the lower guide portion 34 in the widthwise direction of the transport path 11 based on the position of the first lower portion member 34*a* in the widthwise direction of the transport path 11. In each sliding transport mechanism 30, a transport timing detection sensor 78 that detects passing of the paper sheet (see FIG. 5; not shown in FIGS. 1 to 4) is arranged. The transport timing detection sensor 78 is arranged on the bottom surface of the upper guide portion 32 or on the top surface of the lower guide portion 34. When the paper sheet passes the predetermined position in the transport path 11 in each sliding, transport mechanism 30, which is a position between the upper guide portion 32 and the lower guide portion 34, the transport timing detection sensor 78 detects that the paper sheet has passed the predetermined position. Detection information obtained by the sliding transport mechanism position detection sensor 76 and the transport timing detection sensor 78 is transmitted to the later-explained control unit 80.

In the present embodiment, the drive rollers 26 of the first fixed transport unit 20, the drive rollers 36 of each sliding transport mechanism 30, and the drive rollers 56 of the second fixed transport unit 50 are all driven by a single drive system, that is, the roller drive unit 60. Details of a structure of the roller drive unit 60 will be explained with reference to FIGS. 1 and 3. As shown in FIGS. 1 and 3, gear wheels 29*a*, 39*a*, 59*a* are arranged in a leading edge portion of the drive shaft 29 of the drive rollers 26 of the first fixed transport unit 20, the drive shafts 39 of the drive rollers 36 of each sliding transport mechanism 30, and the drive shaft 59 of the drive rollers 56 of the second fixed transport unit 50, respectively. Each drive gear 64 is arranged respectively between the gear wheels 29*a*, 39*a*, 59*a*. A drive gear 62 is arranged so as to engage with the gear wheel 29*a* in a leading edge portion of the drive shaft 29 of the drive rollers 26 of the first fixed transport unit 20. Moreover, a drive gear 61 is arranged so as to engage with the drive gear 62. When the drive gear 61 is rotated by a not-shown drive motor, which can be a stepping motor, for example, the gear wheel 29*a* is rotated via the drive gear 62, and the rotational drive force is transmitted to the gear wheels 39*a* and 59*a* via each drive gear 64. In this manner, each drive shaft 29, 39, 59 integrally rotates, and each drive roller 26, 36, 56 also integrally rotates.

As shown in FIGS. 1 and 3, each drive gear 64 extends along the widthwise direction of the transport path 11 (that is, in the longitudinal direction of each drive shaft 39). With this configuration, even if the upper guide portion 32 and the lower guide portion 34 of each sliding transport mechanism 30 have slid along the widthwise direction of the transport path 11 and the drive shaft 39 of the drive rollers 36 has moved along the widthwise direction of the transport path 11, the engagement between each gear wheel 39*a* and each drive gear 64 will not be released. Accordingly, if the drive shaft 39 of the drive rollers 36 has moved along the widthwise direction of the transport path 11, the drive rollers 26, 36, 56 can be integrally rotated by the roller drive unit 60.

As shown in FIG. 1, in the paper sheet transport apparatus 10, an inlet-side paper sheet detection sensor 70 is arranged on the upstream side of the first fixed transport unit 20 in the paper sheet transport direction. Moreover, an outlet-side paper sheet detection sensor 72 (see FIG. 5, not shown in FIGS. 1 to 4) is arranged on the downstream side of the second fixed transport unit 50 in the paper sheet transport direction. The inlet-side paper sheet detection sensor 70 detects the widthwise length, the position in the widthwise direction of the transport path 11, the skew angle (skew amount), and the like of the paper sheet transported by the upstream side transport unit 12 along the transport path 11. Detection information about the paper sheet obtained by the inlet-side paper sheet detection sensor 70 is transmitted to the later-explained control unit 80. The outlet-side paper sheet detection sensor 72 detects the widthwise length, the position in the widthwise direction of the transport path 11, the skew angle (skew amount), and the like of the paper sheet transported after having been aligned by each sliding transport mechanism 30 to the predetermined position (e.g., the center position and the like) in the widthwise direction of the transport path 11. Detection information about the paper sheet obtained by the outlet-side paper sheet detection sensor 72 is also transmitted to the later-explained control unit 80. The control unit 80 determines whether the paper sheet is accurately aligned by each sliding transport mechanism 30 to the predetermined position in the widthwise direction of the transport path 11 based on the detection information about the paper sheet received from the outlet-side paper sheet detection sensor 72.

As shown in FIG. 1 and the like, in the paper sheet transport apparatus 10, inlet-side transport timing detection sensors 74 are arranged at positions on the upstream side of the first fixed transport unit 20 but on the downstream side of the inlet-side paper sheet detection sensor 70 in the paper sheet transport direction. Outlet-side transport timing detection sensors 75 (see FIG. 5, not shown in FIGS. 1 to 4) is arranged at positions on the downstream side of the second fixed transport unit 50 but on the upstream side of the outlet-side paper sheet detection sensor 72 in the paper sheet transport direction. The inlet-side transport timing detection sensors 74 detect a timing immediately before the paper sheet is transmitted to the first fixed transport unit 20. The outlet-side transport timing detection sensors 75 detect a timing of transporting the paper sheet from the second fixed transport unit 50 after the position of the paper sheet in the widthwise direction of the transport path 11 has been aligned by each sliding transport mechanism 30 to the predetermined position. Detection information about the paper sheet obtained by the inlet-side transport timing detection sensors 74 and the outlet-side transport timing detection sensors 75 is respectively transmitted to the later-explained control unit 80.

As shown in FIG. 5, the control unit 80 is arranged in the paper sheet transport apparatus 10 according to the present embodiment, and the components of the paper sheet transport apparatus 10 are controlled by the control unit 80. To explain in more detail, the upstream side transport unit 12, the drive motors 46 of the sliding transport mechanisms 30, and the roller drive unit 60 are connected to the control unit 80. The control unit 80 transmits command signals to the upstream side transport unit 12, the drive motors 46 of the sliding transport mechanisms 30, and the roller drive unit 60 to control these components. The inlet-side paper sheet detection sensor 70, the outlet-side paper sheet detection sensor 72, the inlet-side transport timing detection sensors 74, the outlet-side transport timing detection sensors 75, and the sliding transport mechanism position detection sensor 76 and the transport timing detection sensor 78 of the sliding transport mechanisms 30 are connected to the control unit 80. Detection information is transmitted from the detection sensors 70, 72, 74, 75, 76, 78 to the control unit 80.

In a standby state of the paper sheet transport apparatus 10, the control unit 80 controls the upper guide portion 32 and the lower guide portion 34 of each sliding transport mechanism 30 so as to position them at the center position in the widthwise direction of the transport path 11. The positions of the upper guide portion 32 and the lower guide portion 34 of each sliding transport mechanism 30 in the widthwise direction of the transport path 11 are detected by the sliding transport mechanism position detection sensor 76 arranged in each sliding transport mechanism 30. Thus, the control unit 80 is capable of controlling the upper guide portion 32 and the lower guide portion 34 of each sliding transport mechanism 30 to be moved to an desired position in the widthwise direction of the transport path 11 based on the detection information obtained by the sliding transport mechanism position detection sensor 76.

The control unit 80 calculates the amount of movement of each sliding transport mechanism 30 based on the position of the paper sheet in the widthwise direction of the transport path 11 before having been transported to each sliding transport mechanism 30, which has been detected by the inlet-side paper sheet detection sensor 70, and the previously set predetermined position (e.g., the center position) of the paper sheet in the widthwise direction of the transport path 11. Specifically, if the position of the paper sheet in the widthwise direction of the transport path 11 before having been transported to each sliding transport mechanism 30 detected by the inlet-side paper sheet detection sensor 70 has shifted from the predetermined position (e.g., the center position) of the paper sheet in the widthwise direction of the transport path 11 by 10 mm, for example, the control unit 80 calculates that the amount of movement of each sliding transport mechanism 30 is 10 mm. In the present embodiment, the amount of movement of each sliding transport mechanism 30 is the same as the amount of movement of the transport member constituted by the drive rollers 36 and the driven rollers 38. When the paper sheet is transported by each sliding transport mechanism 30, the control unit 80 controls each sliding transport mechanism 30 so that each sliding transport mechanism 30 is slid along the widthwise direction of the transport path 11 by the amount equal to the calculated movement amount. To explain in more detail, when paper sheets are sequentially transported by each sliding transport mechanism 30, the control unit 80 performs a control for sliding each sliding transport mechanism 30 along the widthwise direction of the transport path 11 so that the sum total of the amount of movement of the paper sheets moved by each sliding transport mechanism 30 is equal to the calculated movement amount. This operation will be explained in more detail below.

Next, operations of the paper sheet transport apparatus 10 having the above-explained configuration (specifically, the method of transporting paper sheets performed by the paper sheet transport apparatus 10) will be explained below with reference to FIGS. 6A and 6B. The following operations of the paper sheet transport apparatus 10 are realized by the control unit 80 controlling the various components of the paper sheet transport apparatus 10.

The paper sheet transmitted to the paper sheet transport apparatus 10 according to the present embodiment is transmitted from right to left in FIGS. 1 and 2. While the paper sheet is transported, first, the widthwise length, the position in the widthwise direction of the transport path 11, the skew angle (skew amount), and the like of the paper sheet are detected by the inlet-side paper sheet detection sensor 70. The detection information obtained by the inlet-side paper sheet detection sensor 70 is transmitted to the control unit 80. The control unit 80 calculates the amount of movement of each sliding transport mechanism 30 (that is, the amount of movement of the transport member constituted by the drive rollers 36 and the driven rollers 38) based on the position, which has been detected by the inlet-side paper sheet detection sensor 70, of the paper sheet in the widthwise direction of the transport path 11 before the paper sheet is transported to each sliding transport mechanism 30, and the previously set predetermined position (e.g., the center position) of the paper sheet in the widthwise direction of the transport path 11. Thereafter, the paper sheet is transported by the upstream side transport unit 12 along the transport path 11 and received by the first fixed transport unit 20. Then, the paper sheet is received by each sliding transport mechanism 30 from the first fixed transport unit 20, and is then transported by each sliding transport mechanism 30 leftward in FIGS. 1 and 2, and is further transported from each sliding transport mechanism 30 to the second fixed transport unit 50. When the paper sheet is sequentially transported by each sliding transport mechanism 30 leftward in FIGS. 1 and 2, the upper guide portion 32 and the lower guide portion 34 of each sliding transport mechanism 30 slide along the widthwise direction of the transport path 11. With this configuration, the position of the paper sheet transported from each sliding transport mechanism 30 to the second fixed transport unit 50 in the widthwise direction of the transport path 11 is aligned to the predetermined position (e.g., the center position) by shifting the paper sheet by each sliding transport mechanism 30 along the widthwise direction of the transport path 11 regardless of the position of the paper sheet in the widthwise direction of the transport path 11 in the first fixed transport unit 20 arranged on the upstream side. This operation will be explained in more detail with reference to FIGS. 6A and 6B. FIGS. 6A(a) to 6A(e) and FIGS. 6B(a) to 6B(f) are explanatory drawings that illustrate the paper sheet transport method performed by the paper sheet transport apparatus 10. The operations shown in FIGS. 6A(a) to 6A(e) are performed first and the operations shown in FIGS. 6B(a) to 6B(f) are performed thereafter. In FIGS. 6A and 6B, the four sliding transport mechanisms 30 will be referred to as a first sliding transport mechanism 30*a*, a second sliding transport mechanism 30*b*, a third sliding transport mechanism 30*c*, and a fourth sliding transport mechanism 30*d*, which are arranged in this order from the upstream side. In FIGS. 6A and 6B, a paper sheet sequentially transported by the first to the fourth sliding transport mechanisms 30*a* to 30*d* is shown with a reference symbol P.

As shown in FIG. 6A(a), when the paper sheet is received by the first fixed transport unit 20 from the upstream side transport unit 12, the position of the paper sheet may have been shifted in the widthwise direction of the transport path 11 from the predetermined position (e.g., the center position). If the position of the paper sheet has been shifted, to align the paper sheet to the predetermined position in the widthwise direction of the transport path 11, as shown in FIG. 6A(b), the first sliding transport mechanism 30*a* and the second sliding transport mechanism 30*b* start to move in a direction of approaching the paper sheet (that is, in the downward direction in FIG. 6A(b)). These movements of the first sliding transport mechanism 30*a* and the second sliding transport mechanism 30*b* are performed before the paper sheet reaches the nip portion formed between each drive rollers 36 and the driven rollers 38 of the first sliding transport mechanism 30*a*. Then, as shown in FIG. 6A(c), after the first sliding transport mechanism 30*a* and the second sliding transport mechanism 30*b* have stopped moving, the paper sheet is fed into the nip portion formed between the drive rollers 36 and the driven rollers 38 of the first sliding transport mechanism 30*a*.

Then, as shown in FIG. 6A(d), after the trailing edge of the paper sheet in the paper sheet transport direction has come out of the nip portion formed between the drive rollers 26 and the driven rollers 28 of the first fixed transport unit 20, the first sliding transport mechanism 30*a* and the second sliding transport mechanism 30*b* are moved toward the predetermined position (e.g., the center position) in the widthwise direction of the transport path 11. While the paper sheet is being nipped between the drive rollers 36 and the driven rollers 38 of the first sliding transport mechanism 30*a* or the second sliding transport mechanism 30*b*, as shown in FIG. 6A(e), the paper sheet is moved so that the paper sheet approaches the predetermined position along the widthwise direction of the transport path 11.

Then, as shown in FIG. 6B(a), while the paper sheet is being transported by the first sliding transport mechanism 30*a* and the second sliding transport mechanism 30*b*, the third sliding transport mechanism 30*c* and the fourth sliding transport mechanism 30*d* start to move in the direction of approaching the paper sheet (that is, in the downward direction in FIG. 6B(a)) to align the paper sheet to the predetermined position (e.g., the center position). This movement of the third sliding transport mechanism 30*c* and the fourth sliding transport mechanism 30*d* is performed before the paper sheet is fed into the nip portion formed between the drive rollers 36 and the driven rollers 38 of the third sliding transport mechanism 30*c*. Then, as shown in FIG. 6B(b), after the third sliding transport mechanism 30*c* and the fourth sliding transport mechanism 30*d* have stopped moving, the paper sheet is fed into the nip portion formed between the drive rollers 36 and the driven rollers 38 of the third sliding transport mechanism 30*c*.

Then, as shown in FIG. 6B(c), after the trailing edge of the paper sheet in the paper sheet transport direction has come out of the nip portion formed between the drive rollers 36 and the driven rollers 38 of the second sliding transport mechanism 30*b*, the third sliding transport mechanism 30*c* and the fourth sliding transport mechanism 30*d* are moved toward the predetermined position (e.g., the center position) in the widthwise direction of the transport path 11 as shown in FIG. 6B(d). In this manner, as shown in FIG. 6B(e), while the paper sheet is being nipped between the drive rollers 36 and the driven rollers 38 of the third sliding transport mechanism 30*c* or the fourth sliding transport mechanism 30*d*, the paper sheet is moved along the widthwise direction of the transport path 11 so as to approach the predetermined position, and thus the paper sheet is positioned at the predetermined position in the widthwise direction of the transport path 11. Thereafter, as shown in FIG. 6B(f), the paper sheet is received by the second fixed transport unit 50 from the fourth sliding transport mechanism 30*d*, and sent from the second fixed transport unit 50 to further downstream side thereof.

During this operation, when a subsequent paper sheet (shown with a reference symbol P' in FIGS. 6B(d) to 6(*f*)) is received by the first fixed transport unit 20 from the upstream side transport unit 12, the position of the subsequent paper sheet may have been shifted in the widthwise direction of the transport path 11 from the predetermined position (e.g., the center position). If the position of the subsequent paper sheet has been shifted, to align the subsequent paper sheet to the predetermined position in the widthwise direction of the transport path 11, as shown in FIG. 6B(f), the first sliding transport mechanism 30*a* and the second sliding transport mechanism 30*b* start to move toward the paper sheet (that is, in the downward direction in FIG. 6B(f)). In this manner, in the present embodiment, when the paper sheet is transported from one sliding transport mechanism (e.g., the first sliding transport mechanism 30*a* and the second sliding transport mechanism 30*b*) to another sliding transport mechanism arranged on a stage subsequent to one sliding transport mechanism (e.g., the third sliding transport mechanism 30*c* and the fourth sliding transport mechanism 30*d*), the control unit 80 performs a control for moving the former sliding transport mechanism (specifically, the first sliding transport mechanism 30*a* and the second sliding transport mechanism 30*b*) to a position where it can receive the subsequent paper sheet.

As explained above, after the paper sheet has been transported from the first sliding transport mechanism 30*a* and the second sliding transport mechanism 30*b* to the third sliding transport mechanism 30*c* and the fourth sliding transport mechanism 30*d*, the first sliding transport mechanism 30*a* and the second sliding transport mechanism 30*b* are moved to a position where it can receive the subsequent paper sheet. Therefore, the paper sheet transport apparatus 10 according to the present embodiment can handle paper sheets that are sequentially fed. In an alternative configuration, if each of the first to the fourth sliding transport mechanisms 30*a* to 30*d* is configured to slide along the widthwise direction of the transport path 11 independently from the other sliding transport mechanisms 30*a* to 30*d*, then after a paper sheet is transported from the first sliding transport mechanism 30*a* to the second sliding transport mechanism 30*b*, the first sliding transport mechanism 30*a* is moved to a position where it can receive the subsequent paper sheet, for example. Thus, such a paper sheet transport apparatus 10 can handle paper sheets that are sequentially fed.

In the paper sheet transport method performed by the first to the fourth sliding transport mechanisms 30*a* to 30*d* shown in FIGS. 6A and 6B, the control unit 80 performs a control for sliding each sliding transport mechanism 30*a* to 30*d* along the widthwise direction of the transport path 11 so that the sum total of the amount of movement of the paper sheet moved by the first to the fourth sliding transport mechanisms 30*a* to 30*d* matches with the movement amount calculated when the paper sheets have been detected by the inlet-side paper sheet detection sensor 70 (that is, a distance between the position of the paper sheet in the widthwise direction of the transport path 11 before the paper sheet has been transported to each sliding transport mechanism 30 and the previously set predetermined position of the paper sheet in the widthwise direction of the transport path 11 (e.g., the center position)). Specifically, if the amount of movement of the paper sheet calculated by the control unit 80 when the paper sheet has been detected by the inlet-side paper sheet detection sensor 70 is 18 mm, for example, and if the maximum movement amount of each sliding transport mechanism 30*a* to 30*d* is 10 mm, for example, then the amount of sliding of the paper sheet when the paper sheet is slid by the first sliding transport mechanism 30*a* and the second sliding transport mechanism 30*b* along the widthwise direction of the transport path 11 is set to 10 mm, for example, and the amount of sliding of the paper sheet when the paper sheet is slid by the third sliding transport mechanism 30*c* and the fourth sliding transport mechanism 30*d* along the widthwise direction of the transport path 11 is set to 8 mm, for example.

If the movement amount calculated by the control unit 80 when the paper sheet has been detected by the inlet-side paper sheet detection sensor 70 is smaller than the maximum movement amount of each sliding transport mechanism 30*a* to 30*d*, the control unit 80 performs a control for sliding only one (or only some) of the plural (specifically, four) sliding transport mechanisms 30*a* to 30*d* along the widthwise direction of the transport path 11. Specifically, if the movement amount calculated by the control unit 80 when the paper sheet has been detected by the inlet-side paper sheet detection sensor 70 is 8 mm, for example, and if the maximum movement amount of each sliding transport mechanism 30*a* to 30*d* is 10 mm, for example, then the control unit 80 performs a control for sliding the paper sheet by the first sliding transport mechanism 30*a* and the second sliding transport mechanism 30*b* by 8 mm along the widthwise direction of the transport path 11 and a control for not sliding the third sliding transport mechanism 30*c* and the fourth sliding transport mechanism 30*d* along the widthwise direction of the transport path 11. With this configuration, the number of the sliding transport mechanisms 30 slide along the widthwise direction of the transport path 11 can be reduced.

Timings of starting the movement of each sliding transport mechanism 30*a* to 30*d* in the paper sheet transport method performed by the first to the fourth sliding transport mechanisms 30*a* to 30*d* shown in FIGS. 6A and 6B will be explained below. In the present embodiment, in the control unit 80, a time duration from a time point at which the paper sheet is detected by the inlet-side paper sheet detection sensor 70 or the inlet-side transport timing detection sensors 74 to a time point at which the sliding of each sliding transport mechanism 30*a* to 30*d* is started is set separately in each of the sliding transport mechanisms 30*a* to 30*d*. The control unit 80 controls each sliding transport mechanism 30*a* to 30*d* to start sliding along the widthwise direction of the transport path 11 when previously set time duration has elapsed for each of the sliding transport mechanisms 30*a* to 30*d* after the paper sheet has been detected by the inlet-side paper sheet detection sensor 70 or the inlet-side transport timing detection sensors 74. The timing of starting the movement of each sliding transport mechanism 30*a* to 30*d*, however, is not limited to the one explained here. In an alternative method, the control unit 80 can be configured to perform a control such that when passing of the paper sheet has been detected by the transport timing detection sensor 78 arranged in each sliding transport mechanism 30*a* to 30*d*, the control unit 80 controls the sliding transport mechanisms 30*a* to 30*d* in which this transport timing detection sensor 78 is arranged to start sliding along the widthwise direction of the transport path 11.

In the paper sheet transport method performed by the first to the fourth sliding transport mechanisms 30*a* to 30*d* shown in FIGS. 6A and 6B, the first sliding transport mechanism 30*a* and the second sliding transport mechanism 30*b* integrally slide along the widthwise direction of the transport path 11 and the third sliding transport mechanism 30*c* and the fourth sliding transport mechanism 30*d* integrally slide along the widthwise direction of the transport path 11. However, the present embodiment is not limited to the configuration explained above. In an alternative configuration, each of the first to the fourth sliding transport mechanisms 30*a* to 30*d* can be configured to slide along the widthwise direction of the transport path 11 independently from the other sliding transport mechanisms 30*a* to 30*d*. The control unit 80 performs a control such that after each sliding transport mechanism 30*a* to 30*d* have transported the paper sheet, the sliding transport mechanisms 30*a* to 30*d* are returned to the predetermined position (e.g., the center position) in the widthwise direction of the transport path 11.

However, the present embodiment is not limited to the above-explained configuration. In an alternative configuration, the control unit 80 can be configured to perform a control such that after each sliding transport mechanism 30*a* to 30*d* have transported the paper sheet, each sliding transport mechanism 30*a* to 30*d* is controlled to start sliding to a position where it can receive a subsequent paper sheet and be ready for transporting the subsequent paper sheet.

The paper sheet transport method performed by the paper sheet transport apparatus 10 shown in FIG. 1 and the like is not limited to the example shown in FIGS. 6A and 6B. Another example of the paper sheet transport method performed by the paper sheet transport apparatus 10 shown in FIG. 1 and the like will be explained with reference to FIGS. 7(*a*) to 7(*f*). In FIG. 7, similarly to FIGS. 6A and 6B, four sliding transport mechanisms 30 include the first sliding transport mechanism 30*a*, the second sliding transport mechanism 30*b*, the third sliding transport mechanism 30*c*, and the fourth sliding transport mechanism 30*d* arranged in this order from the upstream side. In FIG. 7, a paper sheet to be sequentially transported by the first to the fourth sliding transport mechanisms 30*a* to 30*d* is shown with a reference symbol P.

As shown in FIG. 7(*a*), when the paper sheet is received by the first fixed transport unit 20 from the upstream side transport unit 12, the position of the paper sheet may have been shifted in the widthwise direction of the transport path 11 from the predetermined position (e.g., the center position). If the position of the paper sheet has shifted, to align the paper sheet to the predetermined position in the widthwise direction of the transport path 11, as shown in FIG. 7(*b*), the first sliding transport mechanism 30*a* and the second sliding transport mechanism 30*b* start moving in the direction of approaching the paper sheet (that is, in the downward direction in FIG. 7(*b*)). For example, if the position of the paper sheet that is transported from the upstream side transport unit 12 to the first fixed transport unit 20 in the widthwise direction of the transport path 11 has shifted from the center position by 20 mm, for example, then the first sliding transport mechanism 30*a* and the second sliding transport mechanism 30*b* are moved from the center position in the downward direction in FIG. 7(*b*) by 5 mm, for example. This movement of the first sliding transport mechanism 30*a* and the second sliding transport mechanism 30*b* is performed before the paper sheet is fed into the nip portion formed between the drive rollers 36 and the driven rollers 38 of the first sliding transport mechanism 30*a*. In the configuration shown in FIG. 7, the distance of movement of the first sliding transport mechanism 30*a* and the second sliding transport mechanism 30*b* from the predetermined position (e.g., the center position) is half of the same distance in the configuration shown in FIGS. 6A and 6B. Then, as shown in FIG. 7(*c*), after the trailing edge of the paper sheet in the paper sheet transport direction has come out of the nip portion formed between the drive rollers 26 and the driven rollers 28 of the first fixed transport unit 20, the first sliding transport mechanism 30*a* and the second sliding transport mechanism 30*b* are moved in the upward direction so that the paper sheet approaches the predetermined position (e.g., the center position) in the widthwise direction of the transport path 11. During this operation, the first sliding transport mechanism 30*a* and the second sliding transport mechanism 30*b* are controlled to move to a position in the upward direction in FIG. 7(*c*) from the predetermined position. Specifically, the first sliding transport mechanism 30*a* and the second sliding transport mechanism 30*b* are moved in the upward direction in FIG. 7(*c*) from the center position by 5 mm, for example. With the above-explained configuration, the amount of shift of the paper sheet from the center position in the widthwise direction of the transport path 11 is reduced to 10 mm.

As shown in FIG. 7(*c*), the third sliding transport mechanism 30*c* and the fourth sliding transport mechanism 30*d* start moving in the direction of approaching the paper sheet (that is, in the downward direction in FIG. 7(*c*)). Specifically, the third sliding transport mechanism 30*c* and the fourth sliding transport mechanism 30*d* are controlled to move in the downward direction in FIG. 7(*c*) from the center position by 5 mm, for example. These movements of the third sliding transport mechanism 30*c* and the fourth sliding transport mechanism 30*d* are performed before the paper sheet is fed into the nip portion formed between the drive rollers 36 and the driven rollers 38 of the third sliding transport mechanism 30*c*. In the configuration shown in FIG. 7, the distance of movement of the third sliding transport mechanism 30*c* and the fourth sliding transport mechanism 30*d* from the predetermined position (e.g., the center position) is half of the same distance in the configuration shown in FIGS. 6A and 6B. Then, as shown in FIG. 7(*d*), after the trailing edge of the paper sheet in the paper sheet transport direction has come out of the nip portion formed between the drive rollers 36 and the driven rollers 38 of the second sliding transport mechanism 30*b*, the first sliding transport mechanism 30*a* and the second sliding transport mechanism 30*b* return to the predetermined position (specifically, the center position). At the same time, as shown in FIG. 7(*e*), the third sliding transport mechanism 30*c* and the fourth sliding transport mechanism 30*d* are moved in the upward direction so that the paper sheet further approaches the predetermined position (e.g., the center position) in the widthwise direction of the transport path 11. In this operation, the third sliding transport mechanism 30*c* and the fourth sliding transport mechanism 30*d* are controlled to move to a position in the upward direction in FIG. 7(*e*) from the predetermined position. Specifically, the third sliding transport mechanism 30*c* and the fourth sliding transport mechanism 30*d* are moved in the upward direction in FIG. 7(*e*) from the center position by 5 mm, for example. By performing the above-explained operation, the amount of shift of the paper sheet from the center position in the widthwise direction of the transport path 11 becomes 0 mm, and thus the paper sheet is positioned at the predetermined position in the widthwise direction of the transport path 11. Then, as shown in FIG. 7(*f*), the paper sheet is transported from the fourth sliding transport mechanism 30*d* to the second fixed transport unit 50, and sent by the second fixed transport unit 50 to further downstream side thereof. The third sliding transport mechanism 30*c* and the fourth sliding transport mechanism 30*d* return to the predetermined position (specifically, the center position).

As explained above, also by the paper sheet transport method shown in FIG. 7, when the paper sheet is transported by the plural sliding transport mechanisms 30*a* to 30*d*, each sliding transport mechanism 30*a* to 30*d* is controlled to slide along the widthwise direction of the transport path 11 based on the amount of deviation between the previously set predetermined position in the widthwise direction of the transport path 11 and the actual position of the paper sheet in the widthwise direction of the transport path 11. Therefore, the paper sheet can be surely moved along the widthwise direction of the transport path 11 to be aligned to the predetermined position. Moreover, in the paper sheet transport method shown in FIG. 7, each sliding transport mechanism 30*a* to 30*d* is moved to both sides (specifically, the upper side and the lower side in FIG. 7) of the predetermined position (e.g., the center position) in the widthwise direction of the transport path 11. Therefore, the amount of movement of each sliding transport mechanism 30*a* to 30*d* with respect to the predetermined position (e.g., the center position) in the widthwise direction of the transport path 11 becomes half of the same in the configuration shown in FIGS. 6A and 6B. Therefore, the dimension of the transport path 11 itself in the widthwise direction can be reduced, and a more compact paper sheet transport apparatus 10 can be realized.

In the paper sheet transport apparatus 10 according to the present embodiment, when the paper sheet has been detected by the inlet-side paper sheet detection sensor 70 and if the paper sheet is skewed, the skewed state of the paper sheet can be corrected between the first fixed transport unit 20 and the first sliding transport mechanism 30*a*, between the sliding transport mechanisms 30*a* to 30*d*, or between the fourth sliding transport mechanism 30*d* and the second fixed transport unit 50. The method of correcting the skewed state of the paper sheet performed by the paper sheet transport apparatus 10 will be explained with reference to FIG. 8.

In FIG. 8, a method of correcting the skewed state of a paper sheet (shown with a reference symbol P in FIG. 8) that is transported from the first fixed transport unit 20 to the first sliding transport mechanism 30*a* is shown. Specifically, based on the skew angle (skew amount) of the paper sheet that has been detected by the inlet-side paper sheet detection sensor 70, the control unit 80 performs a control, to correct the skewed state of the paper sheet to be transported from the first fixed transport unit 20 to the first sliding transport mechanism 30*a*, so that the upper guide portion 32 and the lower guide portion 34 of the first sliding transport mechanism 30*a* are moved along the widthwise direction of the transport path 11 toward the side on which the leading corner of the skewed banknote is approaching (that is, the lower side in the example shown in FIG. 8). Specifically, the upper guide portion 32 and the lower guide portion 34 of the first sliding transport mechanism 30*a* are moved in the downward direction in FIG. 8 along the widthwise direction of the transport path 11 based on the skew angle (skew amount) of the paper sheet detected by the inlet-side paper sheet detection sensor 70 when the paper sheet is transported from the first fixed transport unit 20 to the first sliding transport mechanism 30*a*. During this operation, the drive rollers 36 and the driven rollers 38 of the first sliding transport mechanism 30*a* that are holding the paper sheet in a front region of the paper sheet in the paper sheet transport direction are also moved in the downward direction in FIG. 8 along the widthwise direction of the transport path 11. On the contrary, the drive rollers 26 and the driven rollers 28 of the first fixed transport unit 20 that are holding the paper sheet in a rear region of the paper sheet in the paper sheet transport direction are not moved. Accordingly, the paper sheet is rotated around a position Q, which is an intermediate position between the left and the right drive rollers 26 of the first fixed transport unit 20, in the counterclockwise direction in FIG. 8 (see an arrow in FIG. 8) along the transport path 11, and thereby the skewed state of the paper sheet is corrected. The amount of movement of the upper guide portion 32 and the lower guide portion 34 of the first sliding transport mechanism 30*a* employed for the correction of the skewed state of the paper sheet is calculated based on the skew angle (skew amount) of the paper sheet detected by the inlet-side paper sheet detection sensor 70.

In correcting the skewed state of the paper sheet by the method shown in FIG. 8, the control unit 80 controls the roller drive unit 60 to adjust the rotation speed of each of the left and the right drive rollers 36 arranged in the first sliding transport mechanism 30*a*. This adjustment of the rotation speed of each drive roller 36 is performed based on the skew angle (skew amount) of the paper sheet detected by the inlet-side paper sheet detection sensor 70. By performing this operation, the skewed state of the paper sheet can be more surely corrected.

The timing of performing the correction of the skewed state of the paper sheet by the paper sheet transport apparatus 10 is not limited to the timing of transporting the paper sheet from the first fixed transport unit 20 to the first sliding transport mechanism 30*a*. In an alternative configuration, the control unit 80 can control the upper guide portion 32 and the lower guide portion 34 of the fourth sliding transport mechanism 30*d* to move along the widthwise direction of the transport path 11 so that the skewed state of the paper sheet is corrected based on the skew angle (skew amount) of the paper sheet detected by the inlet-side paper sheet detection sensor 70 when the paper sheet is transported from the fourth sliding transport mechanism 30*d* to the second fixed transport unit 50. In this configuration, the upper guide portion 32 and the lower guide portion 34 of the fourth sliding transport mechanism 30*d* are moved along the widthwise direction of the transport path 11 toward the side of the most trailing corner of the skewed banknote. The skewed state of the paper sheet is corrected in the above-explained manner. In a yet another example, the control unit 80 can perform a control such that when the paper sheet is transported among the sliding transport mechanisms 30*a* to 30*d*, the upper guide portion 32 and the lower guide portion 34 of each sliding transport mechanism 30*a* to 30*d* are moved along the widthwise direction of the transport path 11 so as to correct the skewed state of the paper sheet based on the skew angle (skew amount) of the paper sheet detected by the inlet-side paper sheet detection sensor 70. In this configuration, the skewed state of the paper sheet is corrected by moving the upper guide portion 32 and the lower guide portion 34 of the sliding transport mechanisms 30 that are nipping the paper sheet in the front region of the paper sheet in the paper sheet transport direction along the widthwise direction of the transport path 11 toward the side of the leading corner of the skewed banknote, or by moving the upper guide portion 32 and the lower guide portion 34 of the sliding transport mechanisms 30 that are holding the paper sheet in the rear region of the paper sheet in the paper sheet transport direction along the widthwise direction of the transport path 11 toward the side of the most trailing corner of the skewed banknote.

In the present embodiment, after one or more sliding transport mechanisms 30 arranged on the upstream side in the paper sheet transport direction, of the plural sliding transport mechanisms 30, have corrected the skewed state of the paper sheet, the paper sheet can be aligned to the predetermined position by one or more sliding transport mechanisms 30 arranged on the downstream side in the paper sheet transport direction by moving the paper sheet along the widthwise direction of the transport path 11. In this configuration, the amount of movement of the upper guide portion 32 and the lower guide portion 34 of each sliding transport mechanism 30 when the skewed state of the paper sheet is corrected and the amount of movement of the upper guide portion 32 and the lower guide portion 34 of each sliding transport mechanism 30 when the paper sheet is aligned to the predetermined position in the widthwise direction of the transport path 11 are calculated based on the widthwise length, the position in the widthwise direction of the transport path 11, and the skew angle (skew amount) of the paper sheet detected by the inlet-side paper sheet detection sensor 70.

According to the paper sheet transport apparatus 10 and the paper sheet transport method having the above-explained configuration, when the paper sheet is transported by the plural sliding transport mechanisms 30, the transport member constituted by the drive rollers 36 and the driven rollers 38 can be slid along the widthwise direction of the transport path based on the amount of deviation between the previously set predetermined position in the widthwise direction of the transport path 11 and the actual position of the paper sheet in the widthwise direction of the transport path 11. Therefore, the paper sheet can be surely moved along the widthwise direction of the transport path 11 to be aligned to the predetermined position. Furthermore, the position of the paper sheet in the widthwise direction of the transport path is adjusted not by forcedly shifting the paper sheet by rollers, but by aligning the paper sheet to the predetermined position in the widthwise direction of the transport path 11 by sliding the transport member constituted by the drive rollers 36 and the driven rollers 38 itself along the widthwise direction of the transport path 11. Therefore, damaging of the paper sheet that may occur when the paper sheet is shifted along the widthwise direction of the transport path 11 can be prevented.

In the paper sheet transport apparatus 10 according to the present embodiment, as explained above, the paper sheet is transported by each sliding transport mechanism 30 by nipping the paper sheet between the pair of upper drive rollers 36 and the lower driven rollers 38. Therefore, the paper sheet is always gripped between the drive rollers 36 and the driven rollers 38. Accordingly, the speed with which the paper sheet is transported by each sliding transport mechanism 30 can be stabilized, which enables further improvement of the quality of transport of paper sheets.

In the paper sheet transport apparatus 10 according to the present embodiment, as explained above, in each sliding transport mechanism 30, the sliding transport mechanism position detection sensor 76 that detects the position of the sliding transport mechanisms 30 (specifically, the position of the upper guide portion 32 and the lower guide portion 34) in the widthwise direction of the transport path 11 is arranged. With this configuration, the control unit 80 can perform a control for moving the upper guide portion 32 and the lower guide portion 34 of each sliding transport mechanism 30 to a desired position in the widthwise direction of the transport path 11 based on the detection information from the sliding transport mechanism position detection sensor 76.

In the paper sheet transport apparatus 10 according to the present embodiment, as explained above, the control unit 80 performs a control for sliding each sliding transport mechanism 30 (specifically, the transport member constituted by each drive roller 36 and the driven rollers 38) along the widthwise direction of the transport path 11 so that when the paper sheet is sequentially transported by each sliding transport mechanism 30, the total sum of the amounts of movement of the paper sheet performed by each sliding transport mechanism 30 (that is, the movement amount of the paper sheet moved by the transport member constituted by each drive roller 36 and the driven rollers 38) is equal to the movement amount calculated based on the position of the paper sheet in the widthwise direction of the transport path 11 detected by the inlet-side paper sheet detection sensor 70.

In this configuration, if the calculated movement amount is smaller than the maximum movement amount of each sliding transport mechanism 30, the control unit 80 performs a control so as to move only one (only some) of the sliding transport mechanisms 30 of the plural sliding transport mechanisms 30 along the widthwise direction of the transport path 11. With this configuration, the number of the sliding transport mechanisms 30 to slide along the widthwise direction of the transport path 11 can be reduced.

In the paper sheet transport apparatus 10 according to the present embodiment, as explained above, when the paper sheet is transported from one sliding transport mechanism (e.g., the first sliding transport mechanism 30*a* and the second sliding transport mechanism 30*b*) to another sliding transport mechanism arranged on a stage subsequent to one sliding transport mechanism (e.g., the third sliding transport mechanism 30*c* and the fourth sliding transport mechanism 30*d*), the control unit 80 performs a control for moving the former sliding transport mechanism (specifically, the first sliding transport mechanism 30*a* and the second sliding transport mechanism 30*b*) to a position where it can receive the subsequent paper sheet. With this configuration, plural paper sheets sequentially fed to the paper sheet transport apparatus 10 with a specific interval therebetween can be aligned by the paper sheet transport apparatus 10 to the predetermined position in the widthwise direction of the transport path 11.

In the paper sheet transport apparatus 10 according to the present embodiment, as explained above, in the control unit 80, time duration from a time point at which the paper sheet is detected by the inlet-side paper sheet detection sensor 70 or the inlet-side transport timing detection sensors 74 to a time point at which the sliding of each sliding transport mechanism 30 is started is set for each of the sliding transport mechanisms 30. The control unit 80 controls each sliding transport mechanism 30 to start sliding along the widthwise direction of the transport path 11 when the previously set time duration has elapsed for each of the sliding transport mechanisms 30 after the paper sheet has been detected by the inlet-side paper sheet detection sensor 70 or the inlet-side transport timing detection sensors 74. With this configuration, even if the transport timing detection sensor 78 is omitted from each sliding transport mechanism 30, each of the plural sliding transport mechanisms 30 can be slid along the widthwise direction of the transport path 11 at specific timings at which the paper sheet reaches each sliding transport mechanism 30.

If the transport timing detection sensor 78 that detects passing of the paper sheet is arranged in each sliding transport mechanism 30, the control unit 80 can perform a control such that when passing of the paper sheet is detected by the transport timing detection sensor 78, each sliding transport mechanism 30 in which the transport timing detection sensor 78 is arranged is slid along the widthwise direction of the transport path 11.

In the paper sheet transport apparatus 10 according to the present embodiment, as explained above, the skew amount of the paper sheet is also detected by the inlet-side paper sheet detection sensor 70. The control unit 80 controls each sliding transport mechanism 30 to slide along the widthwise direction of the transport path 11 so that the skewed state of the paper sheet is corrected based on the skew amount of the paper sheet detected by the inlet-side paper sheet detection sensor 70 when the paper sheet is transported from the first fixed transport unit 20 to the first sliding transport mechanism 30*a*, or when the paper sheet is transported from the fourth sliding transport mechanism 30*a* to the second fixed transport unit 50. In an alternative configuration, the control unit 80 can perform a control such that when the paper sheet is transported from one sliding transport mechanism 30 among the plural sliding transport mechanisms 30 to another sliding transport mechanism 30 arranged on a stage subsequent to the sliding transport mechanism 30, at least one of the former sliding transport mechanism 30 and the latter sliding transport mechanism 30 is slid along the widthwise direction of the transport path 11 so as to correct the skewed state of the paper sheet based on the skew amount of the paper sheet detected by the inlet-side paper sheet detection sensor 70. According to the paper sheet transport apparatus 10 having the above-explained configuration, differently from the prior art, the orientation of the paper sheet can be changed not by forcedly changing the orientation by using rollers, but by sliding the sliding transport mechanisms 30 along the widthwise direction of the transport path 11. Accordingly, damaging of the paper sheet that may occur during correction of the skewed state of a paper sheet can be prevented.

In this configuration, the control unit 80 can adjust the rotation speed of each of the plural pairs (specifically, one pair) of drive rollers 36 arranged in each sliding transport mechanism 30 so as to correct the skewed state of the paper sheet based on the skew amount of the paper sheet detected by the inlet-side paper sheet detection sensor 70.

In the paper sheet transport apparatus 10 according to the present embodiment, as explained above, the first fixed transport unit 20, each sliding transport mechanism 30, and the second fixed transport unit 50 are respectively provided with each pair of lower drive rollers 26, 36, 56 and the upper driven rollers 28, 38, 58 that transport the paper sheet by nipping the paper sheet between them. Moreover, the drive rollers 26, 36, 56 of the first fixed transport unit 20, each sliding transport mechanism 30, and the second fixed transport unit 50 are all driven by the single drive system. In this configuration, the drive force from each drive rollers 26, 36, 56 is transmitted between the first fixed transport unit 20, each sliding transport mechanism 30, and the second fixed transport unit 50 via each drive gear 64 that extends along the widthwise direction of the transport path 11.

The configurations of the paper sheet transport apparatus 10 and the paper sheet transport method according to the present embodiment are not limited to the one explained above, and various modifications and alterations thereof are possible.

For example, the predetermined position in the widthwise direction of the transport path 11 to which the paper sheet is aligned by each sliding transport mechanism 30 is not limited to the center position. The predetermined position to which the paper sheet is aligned by each sliding transport mechanism 30 can be a desired position in the widthwise direction of the transport path 11. If the paper sheet transport apparatus 10 according to the present embodiment is used as a banknote transport apparatus to be installed in the apparatus body of a banknote depositing and dispensing apparatus, which performs depositing and dispensing of banknotes, and if various types of storage cassettes arranged in the banknote depositing and dispensing apparatus are installed at the position of the end of the banknote transport apparatus in the widthwise direction of the transport path, then the predetermined position to which the paper sheet is aligned by each sliding transport mechanism 30 can be the position of the end in the widthwise direction of the transport path 11.

The paper sheet transport apparatus 10 according to the present embodiment includes plural sliding transport mechanisms 30; however, the present embodiment is not limited to the above-explained configuration. The paper sheet transport apparatus can include only one sliding transport mechanism 30. In this configuration also, when a paper sheet is transported by the single sliding transport mechanism 30, the sliding transport mechanism 30 is slid based on the amount of deviation between a previously set predetermined position in the transport path 11 and the actual position of the paper sheet in the widthwise direction of the transport path 11, and thereby the paper sheet can be surely moved along the widthwise direction of the transport path 11 to be aligned to the predetermined position.

In a configuration alternative to the configuration in which the drive rollers 26, 36, 56 of the first fixed transport unit 20, each sliding transport mechanism 30, and the second fixed transport unit 50 are driven by the single drive system, the drive rollers 26, 36, 56 can be respectively driven by a corresponding drive motor that can be a stepping motor. In this configuration, each drive roller 26, 36, 56 can be driven independently from other drive rollers.

In the present embodiment, each sliding transport mechanism 30 transports the paper sheet while nipping the paper sheet between the pair of upper drive rollers 36 and the lower driven rollers 38. However, the present embodiment is not limited to this configuration. The transport member can have a different configuration if the paper sheet received from the first fixed transport unit 20 can be transported along the transport path 11 and the paper sheet can be received by the second fixed transport unit 50 after the paper sheet has been aligned to the predetermined position in the widthwise direction of the transport path 11.

Second Embodiment

Figure 9:
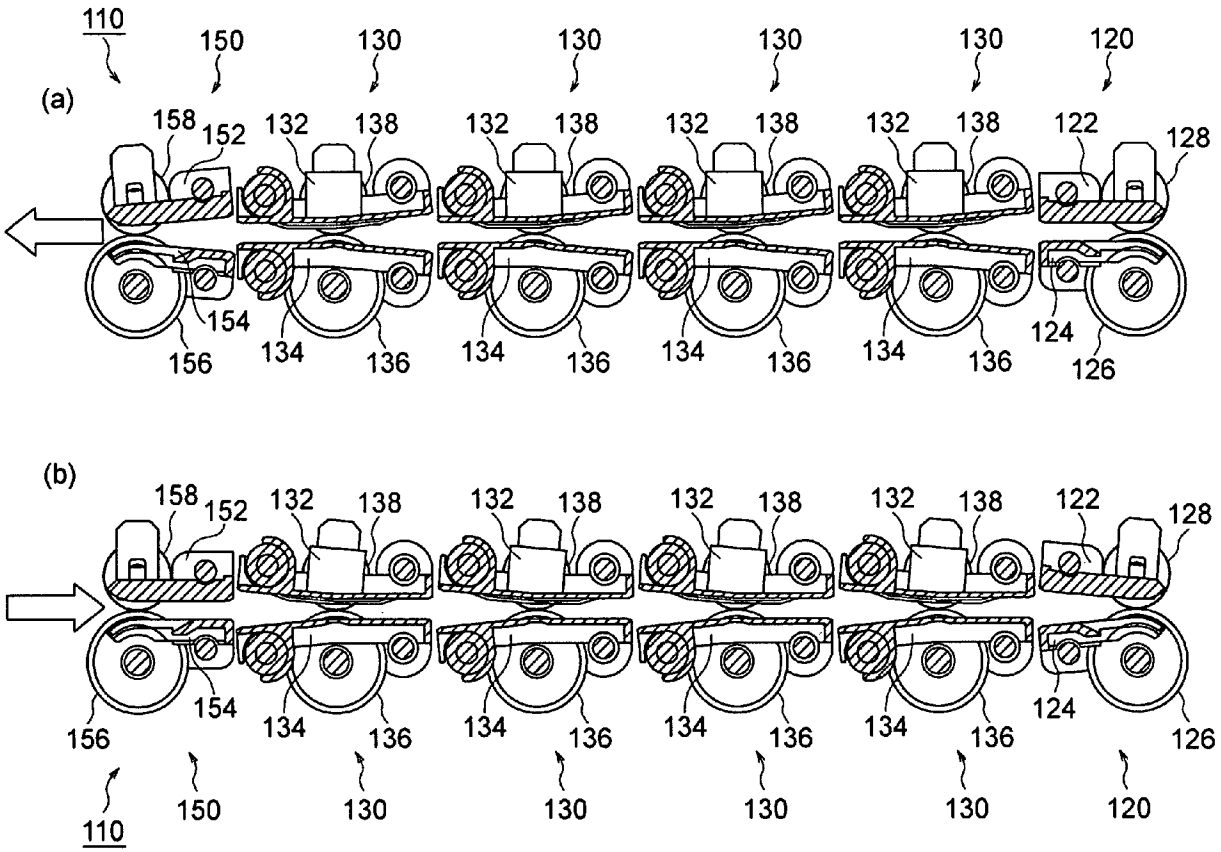
FIG. 9 is a side cross-sectional view of a paper sheet transport apparatus according to a second embodiment of the present invention.
Figure 10:
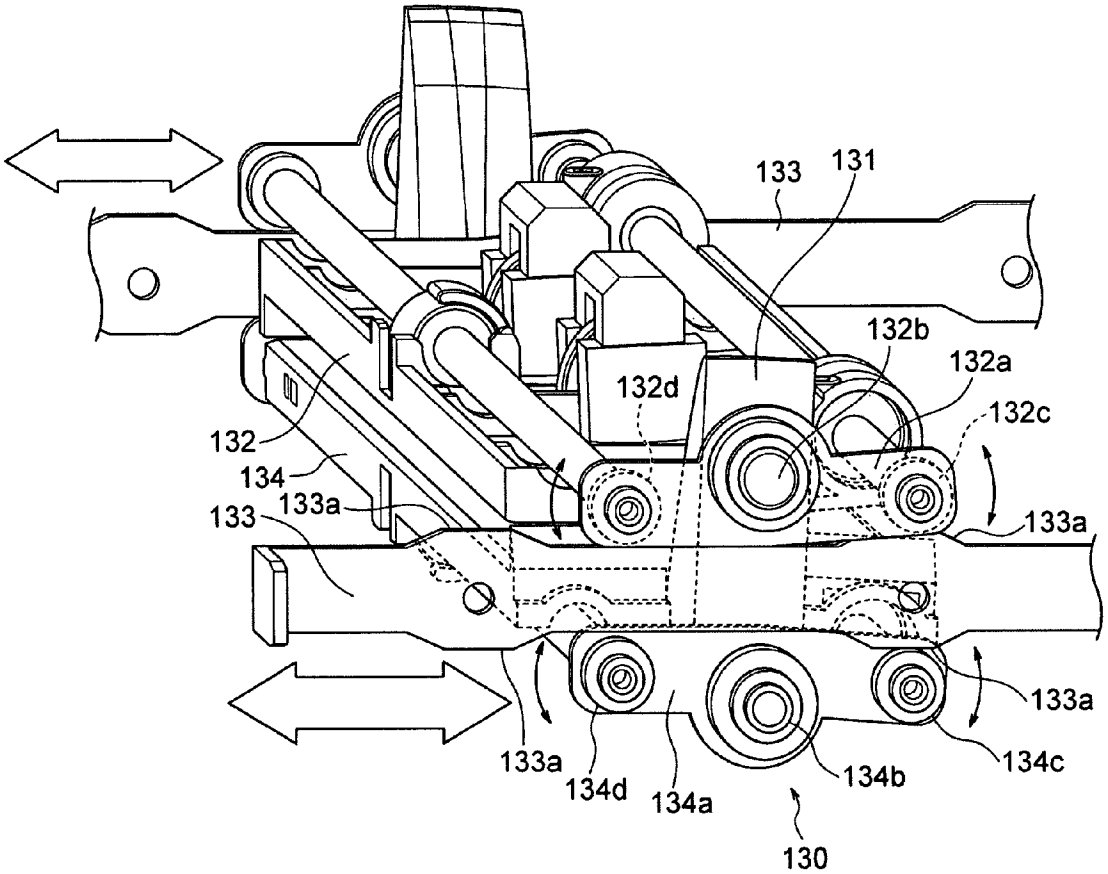
FIG. 10 is a perspective view of a structure of an upper guide portion and a lower guide portion of a sliding transport mechanism of the paper sheet transport apparatus shown in FIG. 9.
Figure 11:
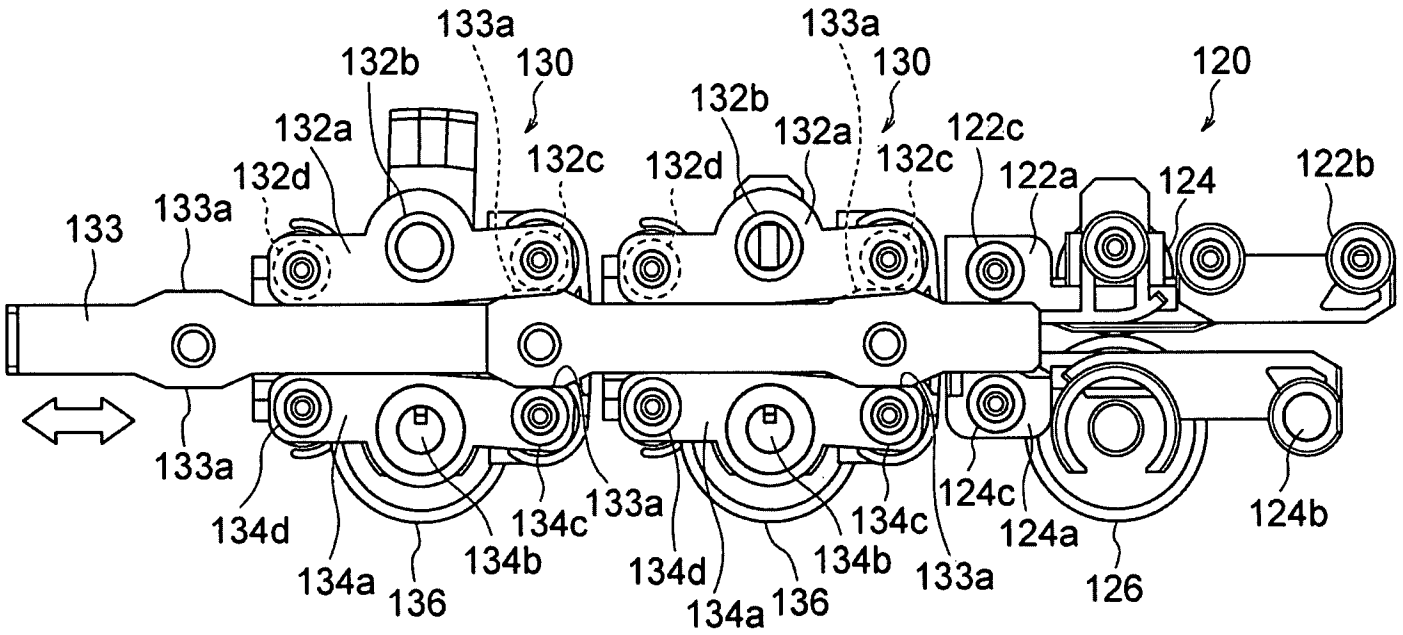
Figure 12:
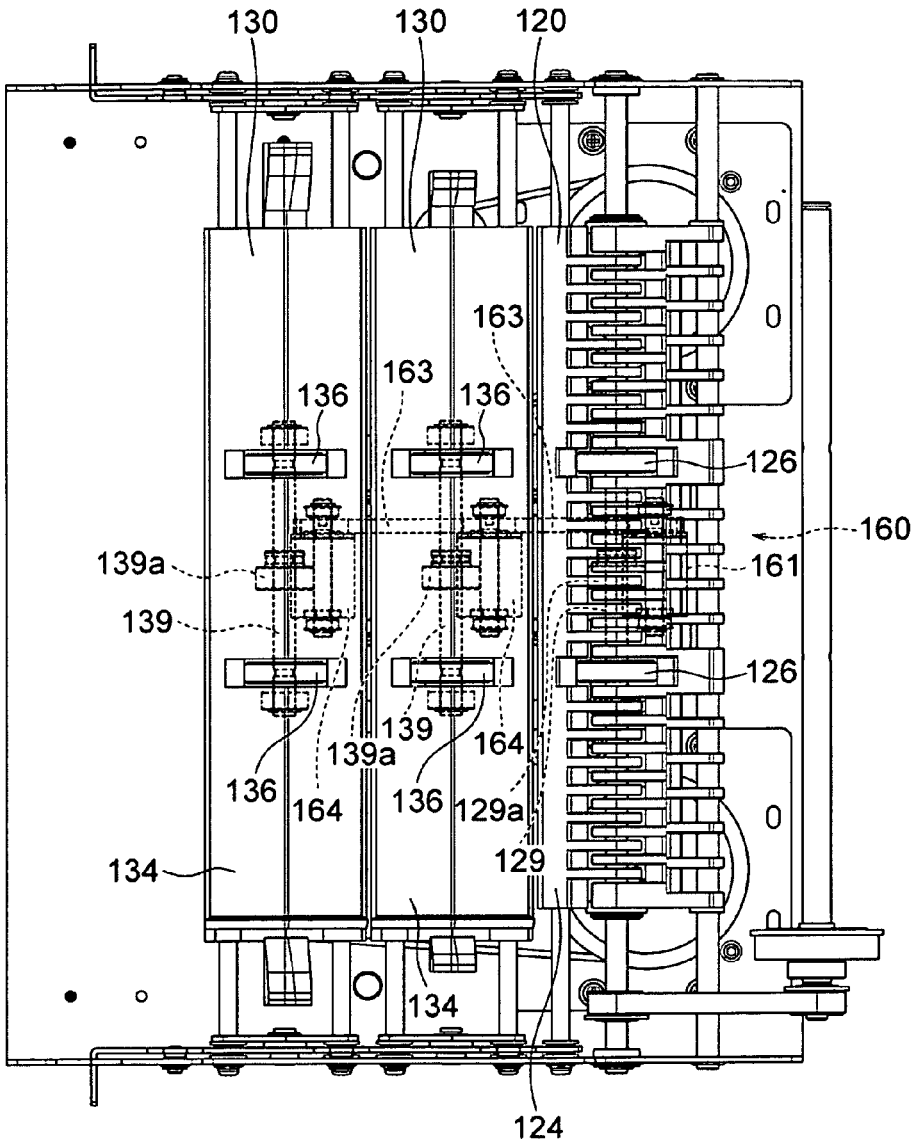
FIG. 12 is a top view of the paper sheet transport apparatus shown in FIG. 9.

A second embodiment of the present invention will be explained below with reference to the accompanying drawings. FIGS. 9 to 12 show a paper sheet transport apparatus and a paper sheet transport method according to the present embodiment. Among the drawings, FIG. 9 is a side cross-sectional view of the paper sheet transport apparatus according to the present embodiment. FIG. 10 is a perspective view of an upper guide portion and a lower guide portion of sliding transport mechanisms of the paper sheet transport apparatus shown in FIG. 9. FIG. 11 is a side view that illustrates a mechanism for rocking the upper guide portion and the lower guide portion of the sliding transport mechanisms of the paper sheet transport apparatus shown in FIG. 9 and the like. Moreover, FIG. 12 is a top view of the paper sheet transport apparatus shown in FIG. 9. In the explanation of the paper sheet transport apparatus according to the present embodiment, explanation of components thereof that are the same as those of the paper sheet transport apparatus 10 according to the first embodiment will not be repeated here.

As shown in FIG. 9, a paper sheet transport apparatus 110 according to the present embodiment includes a first fixed transport unit 120, which is firmly fixed and transports a paper sheet along the transport path; plural (e.g., four) sliding transport mechanisms 130 that are slidable along the widthwise direction of the transport path and transport the paper sheet received from the first fixed transport unit 120; and a second fixed transport unit 150, which is firmly fixed and transports the paper sheet received from each sliding transport mechanism 130.

In the paper sheet transport apparatus 110 according to the present embodiment, in each of the first fixed transport unit 120, each sliding transport mechanism 130, and the second fixed transport unit 150, the shape of a gap between upper guide portions 122, 132, 152 and lower guide portions 124, 134, 154 that constitute the transport path for the paper sheet can be changed depending on the paper sheet transport direction. More specifically, the upper guide portions 122, 132, 152 and the lower guide portions 124, 134, 154 are movable so that the distances between the upper guide portions 122, 132, 152 and the lower guide portions 124, 134, 154 at the side of an inlet and at the side of an outlet of the transport path arranged between the upper guide portions 122, 132, 152 and the lower guide portions 124, 134, 154 can be changed. Specifically, the upper guide portions 122, 132, 152 and the lower guide portions 124, 134, 154 are respectively movable between a position shown in FIG. 9(*a*) and a position shown in FIG. 9(*b*).

With this configuration, in the paper sheet transport apparatus 110 according to the present embodiment, as shown in FIG. 9(*a*) by a hollow arrow, the paper sheet can be fed from the first fixed transport unit 120 to the second fixed transport unit 150 via each sliding transport mechanism 130 (that is, the paper sheet can be transported leftward in FIG. 9(*a*)). Moreover, as shown in FIG. 9(*b*) by a hollow arrow, the paper sheet can be fed from the second fixed transport unit 150 to the first fixed transport unit 120 via each sliding transport mechanism 130 (that is, the paper sheet can be transported rightward in FIG. 9(*b*)). More specifically, in each of the first fixed transport unit 120, each sliding transport mechanism 130, and the second fixed transport unit 150, the position of each upper guide portions 122, 132, 152 and the lower guide portions 124, 134, 154 is switched between the position shown in FIG. 9(*a*) and the position shown in FIG. 9(*b*) depending on the paper sheet transport direction. Thus, the opening on the inlet side of the gap between the upper guide portions 122, 132, 152 and the lower guide portions 124, 134, 154 is set larger than the opening on the outlet side, and thereby the paper sheet hardly collides the inlet-side edge of the upper guide portions 122, 132, 152 and the lower guide portions 124, 134, 154. A configuration of the paper sheet transport apparatus 110 will be explained in detail below.

As shown in FIG. 9, the first fixed transport unit 120 is constituted by the upper guide portion 122 and the lower guide portion 124. The upper guide portion 122 and the lower guide portion 124 arranged so as to be vertically separated from each other with a slight clearance. A transport path for transporting the paper sheet is formed between the upper guide portion 122 and the lower guide portion 124. A pair of left and right drive rollers 126 is arranged in the lower guide portion 124 along the widthwise direction of the transport path. A pair of left and right driven rollers 128 is arranged in the upper guide portion 122 along the widthwise direction of the transport path so as to oppose corresponding drive rollers 126 along the widthwise direction of the transport path. The configuration, of the drive roller 126 is the same as the configuration of the drive roller 26 of the paper sheet transport apparatus 10 according to the first embodiment and the configuration of the driven roller 128 is the same as the driven roller 28 of the paper sheet transport apparatus 10 according to the first embodiment.

Similarly to the first fixed transport unit 120, the second fixed transport unit 150 is constituted by the upper guide portion 152 and the lower guide portion 154. The upper guide portion 152 and the lower guide portion 154 are arranged so as to be vertically separated from each other with a slight clearance. A transport path for transporting the paper sheet is formed between the upper guide portion 152 and the lower guide portion 154. A pair of left and right drive rollers 156 is arranged in the lower guide portion 154 along the widthwise direction of the transport path. A pair of left and right driven rollers 158 is arranged in the upper guide portion 152 along the widthwise direction of the transport path so as to oppose each drive roller 156. The configuration of the drive roller 156 is the same as the configuration of the drive roller 56 of the paper sheet transport apparatus 10 according to the first embodiment, and the configuration of the driven roller 158 is the same as the driven roller 58 of the paper sheet transport apparatus 10 according to the first embodiment.

Plural (e.g., four) sliding transport mechanisms 130 are arranged in tandem between the first fixed transport unit 120 and the second fixed transport unit 150 along the paper sheet transport direction. Similarly to the sliding transport mechanisms 30 of the paper sheet transport apparatus 10 according to the first embodiment, each sliding transport mechanism 130 is slidable along the widthwise direction of the transport path independently from the other sliding transport mechanism 130. With this configuration, if the paper sheet is transported from the first fixed transport unit 120 to the second fixed transport unit 150 via each sliding transport mechanism 130 as shown in FIG. 9(*a*) by the hollow arrow, the paper sheet transported from each sliding transport mechanism 130 to the second fixed transport unit 150 is aligned to the predetermined position (e.g., the center position) with respect to the widthwise direction of the transport path by moving the paper sheet along the widthwise direction of the transport path by each sliding transport mechanism 130 regardless of the position of the paper sheet in the widthwise direction of the transport path in the first fixed transport unit 120 arranged on the upstream side of each sliding transport mechanism 130. Moreover, if the paper sheet is transported from the second fixed transport unit 150 to the first fixed transport unit 120 via each sliding transport mechanism 130 as shown in FIG. 9(*b*) by the hollow arrow, the paper sheet transported from each sliding transport mechanism 130 to the first fixed transport unit 120 is aligned to the predetermined position (e.g., the center position) with respect to the widthwise direction of the transport path by moving the paper sheet along the widthwise direction of the transport path by each sliding transport mechanism 130 regardless of the position of the paper sheet in the second fixed transport unit 150 arranged on the upstream side of each sliding transport mechanism 130.

As shown in FIG. 9, each sliding transport mechanism 130 is constituted by the upper guide portion 132 and the lower guide portion 134. The upper guide portion 132 and the lower guide portion 134 are arranged so as to be vertically separated from each other with a slight clearance, and a transport path for transporting the paper sheet is formed between the upper guide portion 132 and the lower guide portion 134. In this configuration, in each sliding transport mechanism 130, the upper guide portion 132 and the lower guide portion 134 are integrally slidable along the widthwise direction of the transport path. A pair of left and right drive rollers 136 is arranged in the lower guide portion 134 along the widthwise direction of the transport path. A pair of left and right driven rollers 138 is arranged in the upper guide portion 132 along the widthwise direction of the transport path so as to oppose each drive roller 136. The configuration of the drive roller 136 is the same as the drive roller 36 of the paper sheet transport apparatus 10 according to the first embodiment and the configuration of the driven roller 138 is the same as the configuration of the driven roller 38 of the paper sheet transport apparatus 10 according to the first embodiment. In the present embodiment, a transport member that is slidable along the widthwise direction of the transport path and transports the paper sheet along the transport path is constituted by the drive rollers 136 and the driven rollers 138 of each sliding transport mechanism 130.

Next, the configurations of the upper guide portion 132 and the lower guide portion 134 of the sliding transport mechanisms 130 in the paper sheet transport apparatus 110 shown in FIG. 9 will be explained in detail below with reference to FIGS. 10 and 11. In the present embodiment, the upper guide portion 132 includes a side plate 132*a* that rocks around a shaft 132*b* with respect to a fixing member 131 arranged at a fixed position in a direction shown in FIG. 10 by a solid line arrow, and with this configuration, the whole upper guide portion 132 rocks around the shaft 132*b* with respect to the fixing member 131 in a direction shown in FIG. 10 by the arrow. A first roller 132*c* and a second roller 132*d* are respectively rotatably arranged near both ends of the side plate 132*a*. An upper edge of a later-explained link plate 133 contacts an outer circumferential surface of each of the first roller 132*c* and the second roller 132*d*. Similarly, the lower guide portion 134 includes a side plate 134*a* that rocks around a shaft 134*b* with respect to the fixing member 131 arranged at a fixed position in a direction shown in FIG. 10 by a solid line arrow. In this configuration, the whole lower guide portion 134 rocks around the shaft 134*b* with respect to the fixing member 131 in the direction shown in FIG. 10 by the solid line arrow. A first roller 134*c* and a second roller 134*d* are respectively rotatably arranged near both ends of the side plate 134*a*. A lower edge of the later-explained link plate 133 contacts an outer circumferential surface of each of the first roller 134*c* and the second roller 134*d*.

As shown in FIGS. 10 and 11, a pair of link plates 133 extending in a mutually parallel state along the horizontal direction is arranged near both ends of the upper guide portion 132 and the lower guide portion 134 in the widthwise direction of the transport path (that is, in the direction of depth in FIG. 10). Each link plate 133 horizontally oscillates in a direction parallel to the paper sheet transport direction as shown in FIGS. 10 and 11 by hollow arrows. Convex portions 133*a* that respectively protrude in the upward direction and in the downward direction, which correspond to each of the first fixed transport unit 120, each sliding transport mechanism 130, and the second fixed transport unit 150, are arranged on an upper edge and a lower edge of the link plate 133. When the rollers 132*c* and 132*d* of the upper guide portion 132 and the rollers 134*c* and 134*d* of the lower guide portion 134 contact each convex portion 133*a* of the link plate 133 during the oscillation of the link plate 133 along the horizontal direction, the rollers 132*c*, 132*d*, 134*c*, 134*d* are pushed and moved by each convex portion 133*a* of the link plate 133 in the upward direction or the downward direction, and thereby the side plates 132*a* and 134*a* rock around the shaft 132*b* and 134*b*, respectively. In the example shown in FIGS. 10 and 11, when the first roller 132*c* of the upper guide portion 132 and the first roller 134*c* of the lower guide portion 134 respectively contact the convex portions 133*a* of the link plate 133, the rollers 132*c* and 134*c* are pushed and moved by the convex portions 133*a* of the link plate 133 in the upward direction and in the downward direction, respectively, and thereby the side plates 132*a* and 134*a* are rotated around the shafts 132*b* and 134*b*, respectively. In this configuration, for the paper sheet transport path formed in each sliding transport mechanism 130 between the upper guide portion 132 and the lower guide portion 134, an opening on the end on the side of the first fixed transport unit 120 (that is, on the right side in FIGS. 10 and 11) is set larger than an opening on the end on the side of the second fixed transport unit 150 (that is, on the left side in FIGS. 10 and 11). As shown in FIG. 9(*a*), when the link plate 133 is positioned at the above-explained position, also in the second fixed transport unit 150, for the paper sheet transport path formed between the upper guide portion 152 and the lower guide portion 154, an opening on the end on the side closer to the first fixed transport unit 120 (that is, on the right side in FIG. 9) is set larger than an opening on the end on the side more distant from the first fixed transport unit 120 (that is, on the left side in FIG. 9).

As explained above, if a paper sheet is transported from the first fixed transport unit 120 to the second fixed transport unit 150 via each sliding transport mechanism 130 as shown in FIG. 9(*a*) by the hollow arrow, in each sliding transport mechanism 130 and the second fixed transport unit 150, as shown in FIG. 9(*a*), the position of the link plate 133 is adjusted so that an opening on the side of the inlet of the paper sheet transport path formed between the upper guide portions 132 and 152 and the lower guide portions 134 and 154 (that is, on the right side in FIG. 9(*a*)) becomes larger than an opening on the side of the outlet (that is, on the left side in FIG. 9(*a*)). With this configuration, the paper sheet transported in the direction shown in FIG. 9(*a*) by the hollow arrows hardly collides the inlet-side edge of the upper guide portions 132 and 152 or the lower guide portions 134 and 154 of each sliding transport mechanism 130 and the second fixed transport unit 150. Therefore, the paper sheet can be smoothly transported from the first fixed transport unit 120 to the second fixed transport unit 150 via each sliding transport mechanism 130.

On the contrary, if the link plates 133 are moved rightward from the states shown in FIG. 10 or 11 and thus the second roller 132*d* of the upper guide portion 132 and the second roller 134*d* of the lower guide portion 134 have been brought into contact with the convex portions 133*a* of the link plate 133, then the second rollers 132*d* and 134*d* are pushed and moved by the convex portions 133*a* of the link plate 133 upward and downward, respectively, and thus the side plates 132*a* and 134*a* are rotated around the shafts 132*b* and 134*b*, respectively. In this configuration, in each sliding transport mechanism 130, for the paper sheet transport path formed between the upper guide portion 132 and the lower guide portion 134, an opening on the end on the side of the second fixed transport unit 150 (that is, on the left side in FIGS. 10 and 11) becomes larger than an opening on the end on the side of the first fixed transport unit 120 (that is, on the right side in FIGS. 10 and 11). As shown in FIG. 9(*b*), when the link plate 133 is positioned at the above-explained position, also in the first fixed transport unit 120, for the paper sheet transport path formed between the upper guide portion 122 and the lower guide portion 124, an opening on the end on the side closer to the second fixed transport unit 150 (that is, on the left side in FIG. 9) is larger than an opening on the end on the side more distant from the second fixed transport unit 150 (that is, on the right side in FIG. 9).

As explained above, when the paper sheet is transported from the second fixed transport unit 150 to the first fixed transport unit 120 via each sliding transport mechanism 130 as shown in FIG. 9(*b*) by the hollow arrow, as shown in FIG. 9(*b*), in the first fixed transport unit 120 and each sliding transport mechanism 130, the position of the link plate 133 is adjusted so that an opening on the inlet side (that is, on the left side in FIG. 9(*b*)) of the paper sheet transport path formed between the upper guide portions 122 and 132 and the lower guide portions 124 and 134 becomes larger than an opening on the outlet side (that is, on the right side in FIG. 9(*b*)). With this configuration, the paper sheet transported in the direction shown in FIG. 9(*b*) by the hollow arrow hardly collides the inlet-side edge of the upper guide portions 122 and 132 or the lower guide portions 124 and 134 of the first fixed transport unit 120 and each sliding transport mechanism 130. Therefore, the paper sheet can be smoothly transported from the second fixed transport unit 150 to the first fixed transport unit 120 via each sliding transport mechanism 130.

In the paper sheet transport apparatus 110 according to the present embodiment, similarly to the paper sheet transport apparatus 10 according to the first embodiment, the drive rollers 126 of the first fixed transport unit 120, the drive rollers 136 of each sliding transport mechanism 130, and the drive rollers 156 of the second fixed transport unit 150 are driven by a roller drive unit 160 that is a single drive system. Moreover, as shown in FIG. 12, the roller drive unit 160 explained above is installed not on the side of each sliding transport mechanism 130 in the widthwise direction of the transport path but below the lower guide portion 124 of the first fixed transport unit 120, the lower guide portion 134 of each sliding transport mechanism 130, and the like. A configuration of the roller drive unit 160 mentioned above will be explained with reference to FIG. 12.

As shown in FIG. 12, in the paper sheet transport apparatus 110 according to the present embodiment, a drive shaft 129 for the drive roller 126 of the first fixed transport unit 120 and a drive shaft 139 for the drive roller 136 of each sliding transport mechanism 130 are arranged below the lower guide portions 124 and 134, respectively. Although not shown in FIG. 12, a drive shaft for the drive rollers 156 of the second fixed transport unit 150 is arranged also below the lower guide portion 154. In the center position of each of the drive shaft 129 for the drive rollers 126, the drive shaft 139 for the drive rollers 136, and the drive shaft for the drive rollers 156, gear wheels 129*a* and 139*a*, and the like are respectively arranged, and drive gears 161 and 164 engage with the gear wheels 129*a* and 139*a*, and the like, respectively. The drive gears 161 and 164 are connected via drive belts 163. In this configuration, the drive gears 161 and 164 and the drive belts 163 are arranged below the lower guide portions 124 and 134, respectively. The drive gears 161 are rotated by a not-shown drive motor, constituted by a stepping motor and the like, and thus the gear wheels 129*a* and 139*a* and the like are rotated via the drive belts 163 and the drive gears 164. In this manner, the drive shafts 129 and 139, and the like are integrally rotated, and thus the drive rollers 126, 136, 156 are also integrally rotated.

As shown in FIG. 12, the drive gears 164 extend along the widthwise direction of the transport path (that is, in the longitudinal direction of the drive shafts 139). Accordingly, even if the upper guide portion 132 and the lower guide portion 134 of each sliding transport mechanism 130 have slid in the upward-downward direction in FIG. 12 along the widthwise direction of the transport path and the drive shaft 139 of the drive rollers 136 also has moved in the upward-downward direction in FIG. 12 along the widthwise direction of the transport path, the coupling between each gear wheel 139*a* and each drive gear 164 will not be released. With this configuration, even if the drive shaft 139 of the drive rollers 136 has moved along the widthwise direction of the transport path, the drive rollers 126, 136, 156 can be integrally rotated by the roller drive unit 160.

Differently from the first embodiment in which the roller drive unit 60 of the paper sheet transport apparatus 10 is installed on the side of each sliding transport mechanism 30 in the widthwise direction of the transport path, in the paper sheet transport apparatus 110 according to the present embodiment, the roller drive unit 160 is installed below the lower guide portion 124 of the first fixed transport unit 120, the lower guide portion 134 of each sliding transport mechanism 130, and the like. Therefore, the width of the paper sheet transport apparatus 110 itself can be reduced, and the paper sheet transport apparatus 110 can be installed in a smaller space.

Third Embodiment

Figure 13:
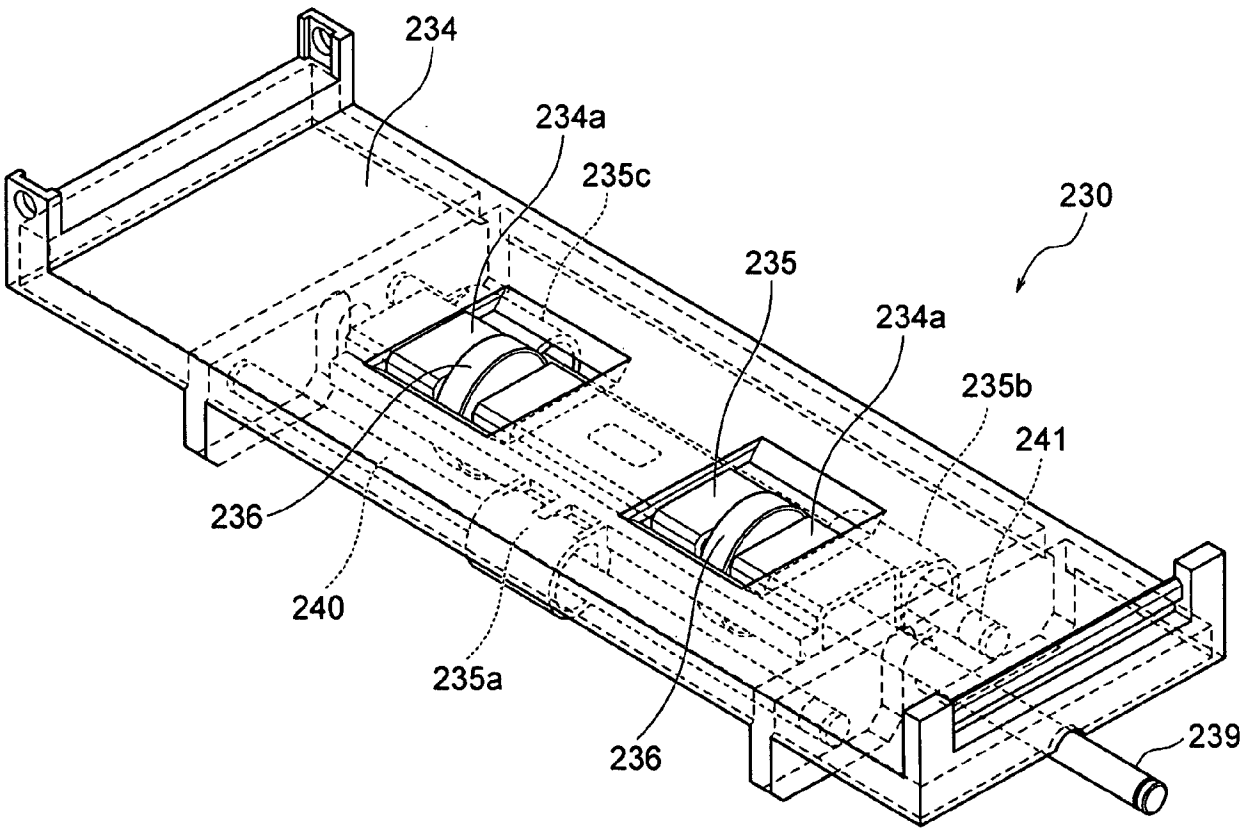
FIG. 13 is a perspective view of a structure of an intermediate transport mechanism of a paper sheet transport apparatus according to a third embodiment of the present invention.
Figure 14:
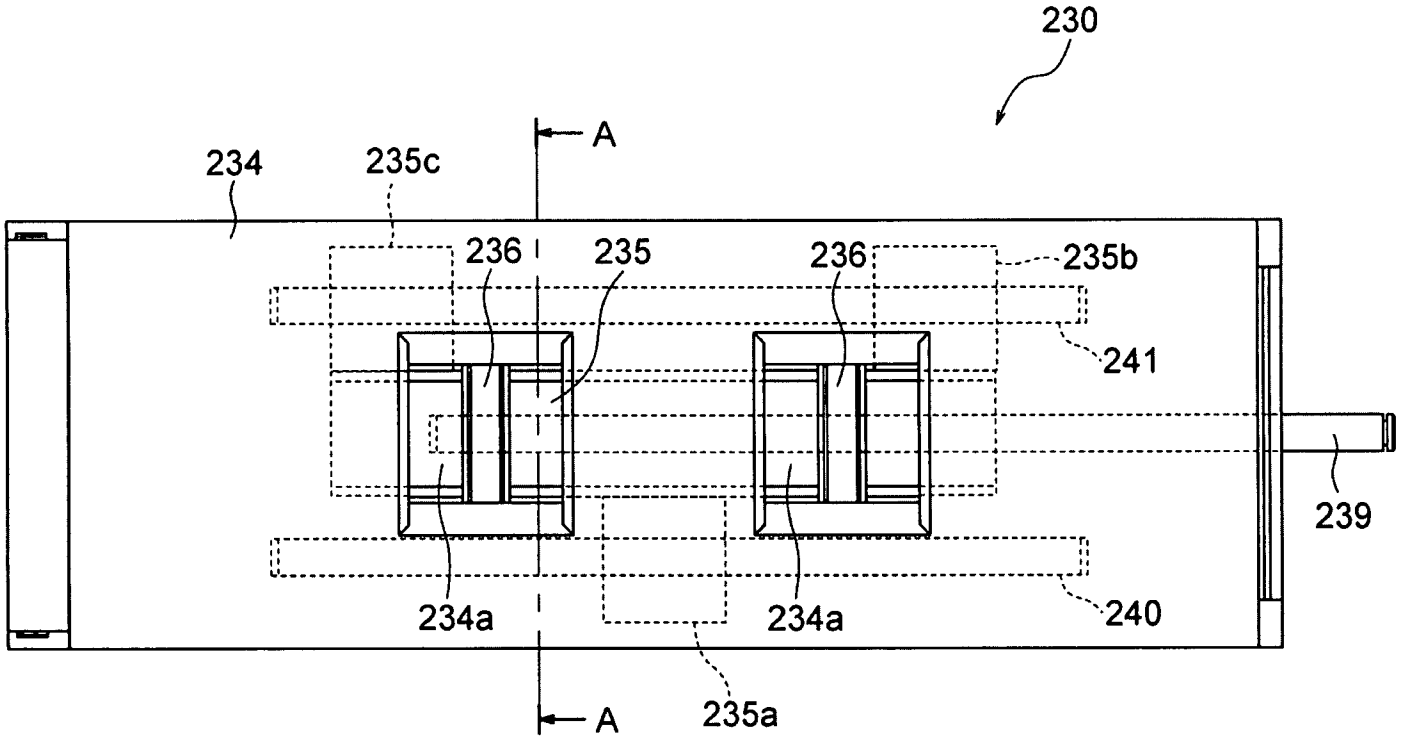
FIG. 14 is a top view of the intermediate transport mechanism shown in FIG. 13.
Figure 15:
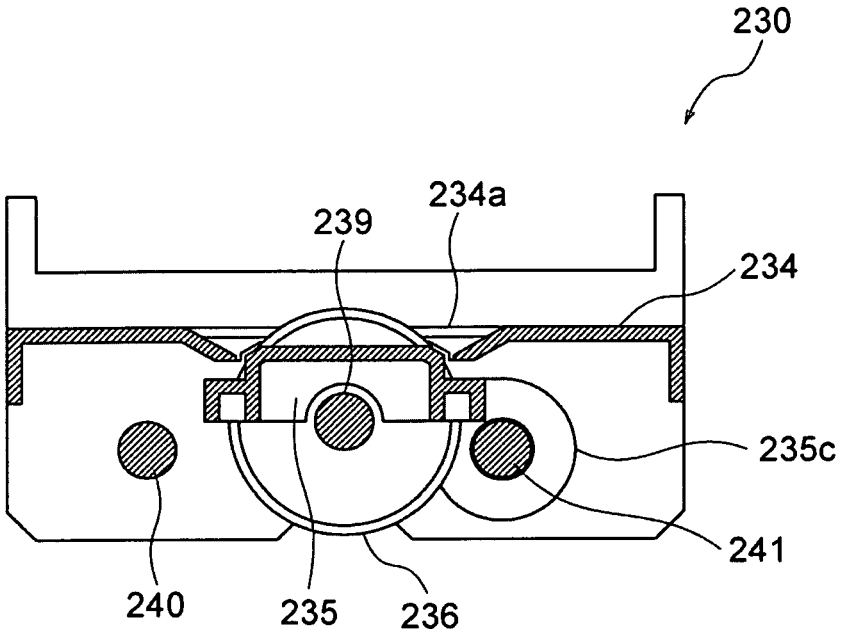
FIG. 15 is a side cross-sectional view of the intermediate transport mechanism when seen along arrows A-A.

A third embodiment of the present invention will be explained below with reference to the accompanying drawings. FIGS. 13 to 15 show a paper sheet transport apparatus and a paper sheet transport method according to the present embodiment. Among them, FIG. 13 is a perspective view of an intermediate transport mechanism of the paper sheet transport apparatus according to the present embodiment, FIG. 14 is a top view of the intermediate transport mechanism shown in FIG. 13, and FIG. 15 is a side cross-sectional view of the intermediate transport mechanism when seen along arrows A-A. In the explanation of the paper sheet transport apparatus according to the present embodiment, explanation of components that are the same as those of the paper sheet transport apparatus 10 according to the first embodiment explained above will not be repeated.

In the present embodiment, differently from the paper sheet transport apparatus 10 according to the first embodiment and the paper sheet transport apparatus 110 according to the second embodiment, plural sliding transport mechanisms slidable along the widthwise direction of the transport path are not arranged between a first fixed transport unit and a second fixed transport unit. Instead, the present embodiment includes plural intermediate transport mechanisms 230 shown in FIGS. 13 to 15 arranged in tandem between the first fixed transport unit and the second fixed transport unit. The intermediate transport mechanism 230 shown in FIGS. 13 to 15 is firmly fixed and cannot slide along the widthwise direction of the transport path. In another example of the paper sheet transport apparatus according to the present embodiment, the intermediate transport mechanism 230 shown in FIGS. 13 to 15 can be arranged in tandem between the first fixed transport unit and the second fixed transport unit, and the intermediate transport mechanisms 230 can be integrated with the first fixed transport unit and the second fixed transport unit to form one transport unit.

The intermediate transport mechanism 230 is constituted by an upper guide portion (not shown) and a lower guide portion 234 arranged so as to be vertically separated from each other with a slight clearance. A transport path for transporting the paper sheet is formed between the upper guide portion and the lower guide portion 234. In the present embodiment, the upper guide portion and the lower guide portion 234 are firmly fixed. As shown in FIGS. 13 to 15, a pair of left and right drive rollers 236 is arranged in the lower guide portion 234 along the widthwise direction of the transport path. Moreover, a pair of left and right driven rollers (not shown) is arranged along the widthwise direction of the transport path so as to oppose each drive roller 236. A drive shaft 239 for rotationally driving the drive rollers 236 is arranged in the drive rollers 236.

In the present embodiment, an opening 234*a* with a substantially rectangular shape is formed in the lower guide portion 234 so as to correspond to the drive roller 236. The drive rollers 236 protrude upward from an upper surface of the lower guide portion 234 through the corresponding openings 234*a* (see FIG. 15). A drive roller supporting portion 235 that supports each drive roller 236 is arranged below the lower guide portion 234. The drive roller supporting portion 235 is constituted by a plate-like member with a substantially rectangular shape and slidable along the widthwise direction of the transport path (that is, in the lateral direction in FIG. 14). With this configuration, each drive roller 236 supported by the drive roller supporting portion 235 is also slidable along the widthwise direction of the transport path. In the paper sheet transport apparatus according to the present embodiment, plural drive roller supporting portions 235 shown in FIGS. 13 to 15 corresponding to each intermediate transport mechanism 230 are arranged, and each drive roller supporting portion 235 can slide independently from one another.

Although not shown in the drawing, an opening with a substantially rectangular shape is formed in the upper guide portions so as to correspond to each driven roller. The driven rollers protrude from a lower surface of the upper guide portion through the corresponding openings. Driven roller supporting portions that support each driven roller are arranged above the upper guide portion. The driven roller supporting portion is constituted by a plate-like member with a substantially rectangular shape and slidable along the widthwise direction of the transport path. Accordingly, each driven roller supported by the driven roller supporting portions is also slidable along the widthwise direction of the transport path. In the paper sheet transport apparatus according to the present embodiment, plural driven roller supporting portions so as to correspond to each intermediate transport mechanism 230 are arranged, and each driven roller supporting portion can slide independently from one another.

In the present embodiment, a transport member slidable along the widthwise direction of the transport path, which is a member that transports the paper sheet along the transport path, is constituted by the drive rollers 236 and the driven rollers of each intermediate transport mechanism 230. Moreover, in the present embodiment, a second guide portion is constituted by the upper guide portion and the lower guide portion 234, in which the transport path is formed between them. In the present embodiment, the second guide portion is firmly fixed, and the transport member constituted by the drive rollers 236 and the driven rollers is slidable along the widthwise direction of the transport path with respect to the firmly fixed second guide portion.

Next, a mechanism for sliding the drive roller supporting portion 235 of the intermediate transport mechanisms 230 along the widthwise direction of the transport path will be explained with reference to FIGS. 13 to 15. As shown in FIGS. 13 and 14, two guide rails 240 and 241 that extend along the widthwise direction of the transport path parallel to each other are arranged below the lower guide portion 234. A first lower portion member 235*a* is attached in the center position on the side of one edge of the drive roller supporting portion 235. A second lower portion member 235*b* and a third lower portion member 235*c* are attached at both end positions on the edge on the other side of the drive roller supporting portion 235, respectively. A cylindrical member is arranged in the first lower portion member 235*a*. The guide rail 240 passes through the cylindrical member.

Accordingly, the first lower portion member 235*a* can be slid and guided along the guide rail 240 in the horizontal direction. A cylindrical member is arranged also in the second lower portion member 235*b* and the third lower portion member 235*c*, respectively. The guide rail 241 is arranged through these cylindrical members. Accordingly, the second lower portion member 235*b* and the third lower portion member 235*c* can be slid and guided along the guide rail 241 in the horizontal direction.

In each intermediate transport mechanism 230, an endless drive belt (not shown) arranged in the horizontal direction is provided below the guide rails 240 and 241, and the drive belt is stretched around plural pulleys (not shown) including drive pulleys (not shown). In each intermediate transport mechanism 230, a drive motor (not shown) that rotates the drive pulley in both the forward and the reverse directions, such as a stepping motor, for example, is arranged. A belt attaching portion (not shown) is arranged in the second lower portion member 235*b* attached on the side edge of the drive roller supporting portion 235, and the belt attaching portion is attached to the drive belt. In this configuration, when the drive motor rotates the drive pulley, the drive belt stretched around the drive pulley is circulated and moved, thus the belt attaching portion is moved in the horizontal direction, and thereby the second lower portion member 235*b* and the third lower portion member 235*c* are moved along the guide rail 241. In this configuration, the first lower portion member 235*a* also moves along the guide rail 240, and the drive roller supporting portion 235 slides along the widthwise direction of the transport path. Thus, the drive rollers 236 supported by the drive roller supporting portion 235 slide along the widthwise direction of the transport path within the openings 234*a* of the lower guide portion 234. In the present embodiment, the rotational driving of the drive pulley by the drive motor is controlled by a control unit having a configuration similar to that of the control unit 80 included in the paper sheet transport apparatus 10 according to the first embodiment.

Although not shown in the drawing, the mechanism for sliding the driven roller supporting portion of each intermediate transport mechanism 230 along the widthwise direction of the transport path also has a configuration similar to that of the mechanism for sliding the drive roller supporting portion 235 of the intermediate transport mechanisms 230 explained above along the widthwise direction of the transport path.

In the present embodiment, differently from the paper sheet transport apparatus 10 according to the first embodiment and the paper sheet transport apparatus 110 according to the second embodiment, it is not necessary that the upper guide portion and the lower guide portion 234 themselves are slidable along the widthwise direction of the transport path. That is, the drive roller supporting portion 235 that supports the drive rollers 236 and the driven roller supporting portion that support the driven rollers only can be slid along the widthwise direction of the transport path. Accordingly, the weight of the members that are slidable in the widthwise direction can be reduced, and thus the load on the drive motor that drives the drive roller supporting portion 235 and the driven roller supporting portion can be reduced. As a result, the response of the components when the drive rollers 236 and the driven rollers slide along the widthwise direction of the transport path can be improved and the life of the drive motor that drives the drive roller supporting portion 235 and the driven roller supporting portion can be lengthened.

As explained above, in the present embodiment, the rotational driving of the drive pulley by the drive motor that drives the drive roller supporting portion 235 and the driven roller supporting portions is controlled by a control unit having a configuration similar to that of the control unit 80 included in the paper sheet transport apparatus 10 according to the first embodiment. To explain in more detail, the control unit arranged in the paper sheet transport apparatus according to the present embodiment calculates the amount of movement of the drive roller supporting portions 235 and the driven roller supporting portions based on the position of the paper sheet in the widthwise direction of the transport path before the paper sheet detected by the inlet-side paper sheet detection sensor 70 is fed to the intermediate transport mechanisms 230 and a previously set predetermined position (e.g., the center position) of the paper sheet in the widthwise direction of the transport path. Specifically, for example, if the position of the paper sheet in the widthwise direction of the transport path before the paper sheet detected by the inlet-side paper sheet detection sensor 70 has been fed to the intermediate transport mechanisms 230 has shifted from the predetermined position (e.g., the center position) of the paper sheet in the widthwise direction of the transport path by 10 mm, then the control unit calculates that the amount of movement of the drive roller supporting portions 235 and the driven roller supporting portions is 10 mm. In the present embodiment, the amount of movements of the drive roller supporting portions 235 and the driven roller supporting portions are the same as the amount of movement of the transport member constituted by the drive rollers 236 and the driven rollers. The control unit controls the intermediate transport mechanisms 230 so as to slide the drive roller supporting portions 235 and the driven roller supporting portions along the widthwise direction of the transport path by the calculated movement amount when the paper sheet is transported by the intermediate transport mechanisms 230. To explain in more detail, the control unit performs a control for sliding the drive roller supporting portions 235 and the driven roller supporting portions along the widthwise direction of the transport path so that the sum total of the amounts of movement of the paper sheet performed by the intermediate transport mechanisms 230 is equal to the calculated movement amount when the paper sheet is transported sequentially by the intermediate transport mechanisms 230.

As explained above, according to the paper sheet transport apparatus of the present embodiment, when the paper sheet is transported by the plural intermediate transport mechanisms 230, the drive roller supporting portions 235 or the driven roller supporting portions are slid based on the amount of deviation between the previously set predetermined position in the widthwise direction of the transport path and the actual position of the paper sheet in the widthwise direction of the transport path. Therefore, the drive rollers 236 and the driven rollers are slid along the widthwise direction of the transport path, and thereby the paper sheet can be surely moved along the widthwise direction of the transport path to be aligned to the predetermined position. Furthermore, differently from the prior art, the position of the paper sheet in the widthwise direction of the transport path is adjusted not by forcedly shifting the paper sheet by rollers but by aligning the paper sheet to the predetermined position in the widthwise direction of the transport path by sliding the transport member constituted by the drive roller 236 and the driven roller itself along the widthwise direction of the transport path, and thereby broken paper sheet that may occur when the paper sheet is displaced along the widthwise direction of the transport path can be prevented.

The invention claimed is:

1. A paper sheet transport apparatus that transports a paper sheet along a transport path, comprising:

a transport member that is slidable along a widthwise direction of the transport path and transports the paper sheet along the transport path;

a paper sheet detection unit that is arranged on an upstream side of the transport member in a paper sheet transport direction along the transport path and detects a position of the paper sheet in the widthwise direction of the transport path;

a control unit that calculates an amount of movement of the transport member based on a position of the paper sheet in the widthwise direction of the transport path detected by the paper sheet detection unit and a previously set predetermined position of the paper sheet in the widthwise direction of the transport path, and performs a control so as to slide the transport member by the calculated movement amount when the paper sheet is transported by the transport member; and a first fixed transport member and a second fixed transport member arranged on an upstream side and on a downstream side of the transport member in the paper sheet transport direction, the first fixed transport member and the second fixed transport member being firmly fixed and transporting the paper sheet along the transport path, wherein the paper sheet detection unit also detects a skew amount of the paper sheet, and the control unit performs a control so as to slide the transport member along the widthwise direction of the transport path so as to correct a skew state of the paper sheet based on the skew amount of the paper sheet detected by the paper sheet detection unit when the paper sheet is transported from the first fixed transport member to the transport member or when the paper sheet is transported from the transport member and received by the second fixed transport member.

2. The paper sheet transport apparatus according to claim 1, wherein the transport member includes a pair of upper and lower rollers that transport the paper sheet by nipping the paper sheet therebetween.

3. The paper sheet transport apparatus according to claim 1, further comprising a position detection unit that detects a position of the transport member in the widthwise direction of the transport path.

4. The paper sheet transport apparatus according to claim 1, wherein the transport member is arranged in a first guide portion comprising the transport path, and the first guide portion is slidable along the widthwise direction of the transport path integrally with the transport member.

5. The paper sheet transport apparatus according to claim 1, wherein the transport member is arranged in a second guide portion comprising the transport path, the second guide portion is firmly fixed, and the transport member is slidable along the widthwise direction of the transport path with respect to the second guide portion.

6. The paper sheet transport apparatus according to claim 1, wherein the transport member comprises a plurality of the transport members arranged in tandem along the paper sheet transport direction, in the transport path, the paper sheet is transported sequentially starting from the transport member arranged on a most upstream side toward the transport members arranged on a downstream side thereof, and the control unit controls the transport members to slide along the widthwise direction of the transport path so that a sum total of amounts of movement of the paper sheet in the widthwise direction of the transport path performed by the transport members is equal to the calculated movement amount when the paper sheet is transported sequentially by the transport members.

7. A paper sheet transport apparatus that transports a paper sheet along a transport path, comprising:

a transport member that is slidable along a widthwise direction of the transport path and transports the paper sheet along the transport path;

a paper sheet detection unit that is arranged on an upstream side of the transport member in a paper sheet transport direction along the transport path and detects a position of the paper sheet in the widthwise direction of the transport path; and a control unit that calculates an amount of movement of the transport member based on a position of the paper sheet in the widthwise direction of the transport path detected by the paper sheet detection unit and a previously set predetermined position of the paper sheet in the widthwise direction of the transport path, and performs a control so as to slide the transport member by the calculated movement amount when the paper sheet is transported by the transport member, wherein the transport member comprises a plurality of the transport members arranged in tandem along the paper sheet transport direction, in the transport path, the paper sheet is transported sequentially starting from the transport member arranged on a most upstream side toward the transport members arranged on a downstream side thereof, the paper sheet detection unit also detects the skew amount of the paper sheet, and when the paper sheet is transported from one transport member to another transport member arranged at a stage subsequent to the one transport member, the control unit controls at least one of the one transport member and the another transport member to slide along the widthwise direction of the transport path so as to correct the skewed state of the paper sheet based on the skew amount of the paper sheet detected by the paper sheet detection unit.

8. The paper sheet transport apparatus according to claim 1, wherein in the transport member, a plurality of pairs of upper and lower rollers that transport the paper sheet by nipping the paper sheet therebetween are arranged in tandem along the widthwise direction of the transport path, and the control unit adjusts a rotation speed of each of the plurality of pairs of rollers arranged in the transport member so as to correct the skewed state of the paper sheet based on the skew amount of the paper sheet detected by the paper sheet detection unit when the paper sheet is transported by the transport member.

9. The paper sheet transport apparatus according to claim 7, wherein the transport member includes a pair of upper and lower rollers that transport the paper sheet by nipping the paper sheet therebetween.

10. The paper sheet transport apparatus according to claim 7, further comprising a position detection unit that detects a position of the transport member in the widthwise direction of the transport path.

11. The paper sheet transport apparatus according to claim 7, wherein the transport member is arranged in a first guide portion comprising the transport path, and the first guide portion is slidable along the widthwise direction of the transport path integrally with the transport member.

12. The paper sheet transport apparatus according to claim 7, wherein the transport member is arranged in a second guide portion comprising the transport path, the second guide portion is firmly fixed, and the transport member is slidable along the widthwise direction of the transport path with respect to the second guide portion.

13. The paper sheet transport apparatus according to claim 7, wherein the transport member comprises a plurality of the transport members arranged in tandem along the paper sheet transport direction, in the transport path, the paper sheet is transported sequentially starting from the transport member arranged on a most upstream side toward the transport members arranged on a downstream side thereof, and the control unit controls the transport members to slide along the widthwise direction of the transport path so that a sum total of amounts of movement of the paper sheet in the widthwise direction of the transport path performed by the transport members is equal to the calculated movement amount when the paper sheet is transported sequentially by the transport members.

14. The paper sheet transport apparatus according to claim 7, wherein in the transport member, a plurality of pairs of upper and lower rollers that transport the paper sheet by nipping the paper sheet therebetween are arranged in tandem along the widthwise direction of the transport path, and the control unit adjusts a rotation speed of each of the plurality of pairs of rollers arranged in the transport member so as to correct the skewed state of the paper sheet based on the skew amount of the paper sheet detected by the paper sheet detection unit when the paper sheet is transported by the transport member.

15. A paper sheet transport apparatus that transports a paper sheet along a transport path, comprising:

a transport member that is slidable along a widthwise direction of the transport path and transports the paper sheet along the transport path;

a paper sheet detection unit that is arranged on an upstream side of the transport member in a paper sheet transport direction along the transport path and detects a position of the paper sheet in the widthwise direction of the transport path;

a control unit that calculates an amount of movement of the transport member based on a position of the paper sheet in the widthwise direction of the transport path detected by the paper sheet detection unit and a previously set predetermined position of the paper sheet in the widthwise direction of the transport path, and performs a control so as to slide the transport member by the calculated movement amount when the paper sheet is transported by the transport member; and a first fixed transport member and a second fixed transport member arranged on the upstream side of and on the downstream side of the transport member in the paper sheet transport direction, the first fixed transport member and the second fixed transport member being firmly fixed and transport the paper sheet along the transport path, wherein the first fixed transport member, the transport member, and the second fixed transport member are constituted by a pair of upper and lower rollers that transport the paper sheet by nipping the paper sheet therebetween, the rollers of the first fixed transport member, the transport member, and the second fixed transport member are driven by a single drive system, and a driving force from the rollers is transmitted between the first fixed transport member, the transport member, and the second fixed transport member via a drive gear that extends along the widthwise direction of the transport path.

16. The paper sheet transport apparatus according to claim 15, wherein the transport member includes a pair of upper and lower rollers that transport the paper sheet by nipping the paper sheet therebetween.

17. The paper sheet transport apparatus according to claim 15, further comprising a position detection unit that detects a position of the transport member in the widthwise direction of the transport path.

18. The paper sheet transport apparatus according to claim 15, wherein the transport member is arranged in a first guide portion comprising the transport path, and the first guide portion is slidable along the widthwise direction of the transport path integrally with the transport member.

19. The paper sheet transport apparatus according to claim 15, wherein the transport member is arranged in a second guide portion comprising the transport path, the second guide portion is firmly fixed, and the transport member is slidable along the widthwise direction of the transport path with respect to the second guide portion.

20. The paper sheet transport apparatus according to claim 15, wherein the transport member comprises a plurality of the transport members arranged in tandem along the paper sheet transport direction, in the transport path, the paper sheet is transported sequentially starting from the transport member arranged on a most upstream side toward the transport members arranged on a downstream side thereof, and the control unit controls the transport members to slide along the widthwise direction of the transport path so that a sum total of amounts of movement of the paper sheet in the widthwise direction of the transport path performed by the transport members is equal to the calculated movement amount when the paper sheet is transported sequentially by the transport members.

* * * * *